US007731551B2

(12) United States Patent
Yoshida et al.

(10) Patent No.: US 7,731,551 B2
(45) Date of Patent: Jun. 8, 2010

(54) CONTACT, METHOD FOR MANUFACTURING CONTACT, CONNECTION DEVICE INCLUDING CONTACT, AND METHOD FOR MANUFACTURING CONNECTION DEVICE

(75) Inventors: Shin Yoshida, Miyagi-ken (JP); Shinichi Nagano, Miyagi-ken (JP)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 11/908,768

(22) PCT Filed: Mar. 7, 2006

(86) PCT No.: PCT/JP2006/304461

§ 371 (c)(1),
(2), (4) Date: Sep. 14, 2007

(87) PCT Pub. No.: WO2006/098201

PCT Pub. Date: Sep. 21, 2006

(65) Prior Publication Data

US 2008/0188101 A1 Aug. 7, 2008

(30) Foreign Application Priority Data

Mar. 16, 2005 (JP) ..... 2005-074522
Jan. 26, 2006 (JP) ..... 2006-017030

(51) Int. Cl.
*H01R 13/02* (2006.01)

(52) U.S. Cl. ..... 439/887; 439/66

(58) Field of Classification Search ..... 439/66, 439/886–887
See application file for complete search history.

(56) References Cited

U.S. PATENT DOCUMENTS

| | | | | |
|---|---|---|---|---|
| 6,763,581 | B2 * | 7/2004 | Hirai et al. | 29/852 |
| 2008/0032519 | A1 * | 2/2008 | Murata | 439/66 |
| 2008/0293263 | A1 * | 11/2008 | Murata | 439/66 |

FOREIGN PATENT DOCUMENTS

| | | |
|---|---|---|
| JP | 61-19080 | 1/1986 |
| JP | 2005-032708 | 2/2005 |

OTHER PUBLICATIONS

International Search Report mailed on Jun. 13, 2006 for corresponding PCT Application PCT/JP2006/304461.

* cited by examiner

*Primary Examiner*—Truc T Nguyen
(74) *Attorney, Agent, or Firm*—Brinks Hofer Gilson & Lione

(57) ABSTRACT

To provide a contact, formed in an amorphous state, having better spring properties as compared to conventional one; a method for manufacturing the contact; a connection device including the contact; and a method for manufacturing the connection device.

The present invention provides a contact comprising an elastically deforming portion that includes at least one amorphous part. The elastically deforming portion includes an auxiliary elastic member 41 made of, for example, NiP (a P content of 15 atomic percent). In this case, an amorphous phase 50 is predominant in the auxiliary elastic member 41. This enhances spring properties such as a yield stress.

16 Claims, 19 Drawing Sheets

X-RAY DIFFRACTION PATTERNS OF
Ni-P ALLOY COATINGS WITH VARIOUS P CONTENTS

X-RAY DIFFRACTION PATTERNS OF
Ni-W ALLOY COATINGS WITH VARIOUS W CONTENTS 5 nm 12.5 at%W 14.9 at%W 5 nm

X-RAY DIFFRACTION PATTERNS OF Ni−19.7 at% W ALLOY COATING HEAT-TREATED AT INCREASING TEMPERATURES

X-RAY DIFFRACTION PATTERNS OF Ni−27.7 at% W ALLOY COATING HEAT-TREATED AT INCREASING TEMPERATURES

CONTACT, METHOD FOR MANUFACTURING CONTACT, CONNECTION DEVICE INCLUDING CONTACT, AND METHOD FOR MANUFACTURING CONNECTION DEVICE

TECHNICAL FIELD

The present invention relates to connection devices (for example, IC sockets) including contacts connected to, for example, ICs (integrated circuits) or the like. The present invention particularly relates to a contact, formed in an amorphous state, having enhanced spring properties; a method for manufacturing the contact; a connection device including the contact; and a method for manufacturing the connection device.

BACKGROUND ART

A semiconductor inspection device disclosed in Patent Document 1 is used to temporarily electrically connect a semiconductor device to an external circuit board or the like. A large number of spherical contacts are arranged on the back of the semiconductor device in a grid or matrix pattern. An insulating substrate opposed to the spherical contacts has a large number of recessed portions, which contain spiral contacts opposed to the spherical contacts.

If the back of the semiconductor device is pressed against the insulating substrate, the spiral contacts are brought into contact with the spherical contacts such that the spiral contacts are spirally wound around the spherical contacts. This allows the spherical contacts to be electrically connected to the spiral contacts securely.

Patent Document 1: Japanese Unexamined Patent Application Publication No. 2002-175859

DISCLOSURE OF THE INVENTION

Problems to be Solved by the Invention

In Patent Document 1, the spiral contacts include copper foils and nickel coatings. Although not being disclosed in Patent Document 1, the following technique is used to secure the contact between the spherical contacts of the semiconductor device and the spiral contacts: a technique in which the spiral contacts are three-dimensionally shaped while the spiral contacts are being heat-treated.

Heat-treatment for three-dimensional shaping causes the crystallization of the spiral contacts. This causes the deterioration of spring properties, for example, the reduction of the yield stress. Therefore, there is a problem in that the spiral contacts cannot properly function as elastic contacts.

As disclosed in Patent Document 1, the nickel coatings are portions of the spiral contacts. Although the spiral contacts are expected to be elastically deformed because the spiral contacts include not only the copper foils but also the nickel coatings, the spiral contacts are frequently damaged or broken. This is because the nickel coatings are rapidly crystallized by heat treatment or the like and therefore become brittle.

If the spiral contacts are not subjected to heat treatment for three-dimensional shaping but are used for a burn-in tester, the spiral contacts are heated. Therefore, the spiral contacts need to have enhanced spring properties under heating conditions The present invention has been made to solve the above problems. It is an object of the present invention to provide a contact, formed in an amorphous state, having better spring properties as compared to conventional one; a method for manufacturing the contact; a connection device including the contact; and a method for manufacturing the connection device.

Means for Solving the Problems

The present invention provides a contact including an elastically deforming portion. The elastically deforming portion includes at least one amorphous part.

Since the elastically deforming portion includes at least one amorphous part, the elastically deforming portion has better spring properties such as a yield stress as compared to conventional one.

In the present invention, it is preferable that the elastically deforming portion include at least one part made of Ni—X (where X is at least one of P, W, and B) and the Ni—X be amorphous. The Ni—X is in an amorphous state and is effective in enhancing spring properties of the elastically deforming portion.

In the present invention, it is preferable that the elastically deforming portion include a conductive member and an auxiliary elastic member, the conductive member have a resistivity less than that of the auxiliary elastic member, and the auxiliary elastic member have a yield point and elastic modulus greater than those of the conductive member and be made of the Ni—X. This configuration is effective in reducing the settling factor as described in experiment results below, effective in enhancing spring properties, and effective in achieving good conductivity.

Element X described above is preferably P. The composition ratio of P is preferably 15 to 30 atomic percent. This is effective in maintaining Ni—X in an amorphous state and effective in enhancing spring properties of the elastically deforming portion.

Element X described above is preferably W. The composition ratio of W is preferably 14.5 to 36 atomic percent and more preferably 20 atomic percent or more. This is effective in maintaining Ni—X in an amorphous state and effective in enhancing spring properties of the elastically deforming portion.

The Ni—X layer is preferably formed by plating.

In the present invention, the contact may include ultra-fine precipitates, having a size of 1 nm or less, other than amorphous portions. The ultra-fine precipitates do not impair spring properties and therefore may be present.

In the present invention, the elastically deforming portion preferably has such a yield point that the load applied thereto is 19.6 mN or more and the distortion thereof is 0.1 mm or more. Experiments below show that the elastically deforming portion can be formed so as to have such a yield point.

In the present invention, the elastically deforming portion preferably has a spiral shape. This allows the elastically deforming portion to be brought into good contact with an external connection of an electronic component.

In the present invention, the elastically deforming portion is preferably three-dimensionally shaped under heating conditions. Since the elastically deforming portion is heated, the three-dimensionally shape of the elastically deforming portion is properly maintained. In particular, the elastically deforming portion is maintained in an amorphous state even if the elastically deforming portion is heated during deformation processing. Therefore, the elastically deforming portion has better spring properties as compared to conventional one.

The present invention provides a connection device including a base and a contact, mounted on the base, including an elastically deforming portion brought into contact with an external connection of an electronic component. The elastically deforming portion of the contact has the configuration specified in any one of the above paragraphs. In the present invention, the elastically deforming portion includes at least one amorphous part. Therefore, the elastically deforming portion has better spring properties as compared to conventional one.

The present invention provides a method for manufacturing a contact including an elastically deforming portion. The method includes:

a. a step of forming at least one part of the elastically deforming portion using Ni—X (where X is at least one of P, W, and B); and b. a step of three-dimensionally shaping the elastically deforming portion under heating conditions. The heating temperature in the step (b) is suitable for maintaining the Ni—X in an amorphous state.

The Ni—X has a crystallization temperature higher that that of Ni. Therefore, the Ni—X can be maintained in an amorphous state even if the Ni—X is heated under the same conditions as those for heating a conventional alloy. In the present invention, the Ni—X used to form at least one part of the elastically deforming portion can be maintained in an amorphous state. Therefore, the elastically deforming portion can be formed readily and properly so as to have good spring properties.

In the present invention, the heating temperature in the step (b) is preferably lower than the crystallization temperature of the Ni—X. This allows the Ni—X to be maintained in an amorphous state.

In the present invention, the elastically deforming portion is preferably three-dimensionally shape under heating conditions in such a manner that a stress in the plastic region of the Ni—X is applied to the elastically deforming portion. This is effective in reducing the heating time of the elastically deforming portion.

Element X described above is preferably P. The composition ratio of P is preferably 15 to 30 atomic percent. The heating temperature is preferably 200° C. to 300° C. This allows NiP to be maintained in an amorphous state.

Alternatively, element X described above may be W. In this case, the composition ratio of W is preferably 14.5 to 36 atomic percent and more preferably 20 atomic percent or more. The heating temperature is preferably 200° C. to 700° C.

This allows NiW to be maintained in an amorphous state.

The present invention provides a method for manufacturing a connection device including a base and a contact, mounted on the base, including an elastically deforming portion brought into contact with an external connection of an electronic component. The method includes a step of forming the elastically deforming portion of the contact by the contact-manufacturing method specified in any one of the above paragraphs. This allows at least one part of the elastically deforming portion to be maintained in an amorphous state. Therefore, the connection device, which includes the contact having better spring properties as compared to conventional one, can be manufactured properly and readily.

ADVANTAGE

The present invention provides a contact including an elastically deforming portion. The elastically deforming portion includes at least one amorphous part. Since the elastically deforming portion includes at least one amorphous part, the elastically deforming portion has better spring properties such as a yield stress as compared to conventional one.

BEST METHOD FOR CARRYING OUT THE INVENTION

FIG. 1 is a perspective view of an inspection device used for a test for checking the operation of electronic components. FIG. 2 is a sectional view of the inspection device taken along the line 2-2 of FIG. 1, the inspection device being connected to an electronic component.

With reference to FIG. 1, the inspection device 10 includes a base 11 and a lid 12 rotatably supported with a hinge portion 13 located at an end portion of the base 11. The base 11 and the lid 12 are made of an insulating resin material or the like. The base 11 has a loading region 11A located in a center area thereof. The loading region 11A is recessed in the Z2 direction in this figure. An electronic component 1 such as a semiconductor component can be mounted in the loading region 11A. The base 11 has a latch-receiving portion 14 located at another end portion thereof.

The inspection device 10 is used to inspect the electronic component 1 or the like. With reference to FIG. 2, the electronic component 1 includes a large number of connection terminals 1*a* (for example, spherical connection terminals as shown in FIG. 2) arranged in a matrix pattern (a grid or check pattern) on the lower surface thereof.

With reference to FIG. 2, the base 11 has a plurality of through-holes 11*a* which have a predetermined diameter and length and which extend from a surface of the loading region 11A to the rear surface of the base 11. The through-holes 11*a* are located so as to correspond to the connection terminals 1*a* of the electronic component 1.

A plurality of spiral contacts 20 with a spiral shape are arranged above the connection terminals 1*a* (on the loading region 11A).

FIG. 3 is a perspective view showing the spiral contacts 20. With reference to FIG. 3, the spiral contacts 20 are arranged on the base 11 at predetermined intervals in the X direction and Y direction in this figure.

With reference to FIG. 3, the spiral contacts 20 each have a base portion 21 fixed at the edge of the upper end of each through-hole 11*a*, as is clear from the upper left spiral contact 20. The leading end 22 of each spiral contact 20 is located on the base portion 21 side. The spiral contact 20 spirally extends from the leading end 22 to the trailing end 23 thereof. The trailing end 23 is located at substantially the center of the through-hole 11*a*. The spiral contact 20 has a spiral portion that is located at a position opposed to the through-hole 11*a* in the height direction. This portion functions as an elastically deforming portion 20*a*.

The through-hole 11*a* has a conductive portion, which is not shown, disposed on the wall thereof. The upper end of the conductive portion is connected to the base portion 21 of the spiral contacts 20 with a conductive adhesive or the like. The lower end of the through-hole 11*a* is sealed with a connection terminal 18.

With reference to FIG. 2, a printed board 30 having a plurality of wiring patterns and circuit components is disposed under the base 11. The base 11 is fixed on the printed board 30. The connection terminals 18 are arranged on the lower surface of the base 11. Counter electrodes 31 opposed to the connection terminals 18 are arranged on the printed board 30. The connection terminals 18 are brought into contact with the corresponding counter electrodes 31, whereby the electronic component 1 is electrically connected to the printed board 30 with the inspection device 10.

The lid 12 of the inspection device 10 has a pressing portion 12*a* for pressing the electronic component 1 downward. The pressing portion 12*a* projects from a center area of the inner surface of the lid 12 and is opposed to the loading region 11A. A latch portion 15 is located on the side opposite to the hinge portion 13.

An urging member (not shown), including a coil spring, for urging the pressing portion 12*a* away from the inner surface of the lid 12 is disposed between the inner surface of the lid 12 and the pressing portion 12*a*. Therefore, the electronic component 1 can be elastically pressed in the direction (the Z2 direction) toward the loading region 11A in such a manner that the electronic component 1 is mounted in the through-holes 11*a* and the lid 12 is closed and then locked.

The loading region 11A of the base 11 has a size substantially equal to the outside dimension of the electronic component 1. The connection terminals 1*a* of the electronic component 1 can be precisely aligned with the corresponding spiral contacts 20 of the inspection device 10 in such a manner that the electronic component 1 is mounted in the loading region 11A and the lid 12 is then locked.

If the latch portion 15 is engaged with the latch-receiving portion 14 of the base 11, the electronic component 1 is pressed downward with the pressing portion 12*a* and therefore the spiral contacts 20 are pressed in the inward direction (the downward direction) of the through-holes 11*a* with the connection terminals 1*a*. Furthermore, the elastically deforming portion 20*a* of each spiral contact 20 is deformed such that the elastically deforming portion 20*a* is expanded in the direction from the trailing end 23 to the leading end 22. This allows the elastically deforming portion 20*a* to wind around one of the connection terminals 1*a*, resulting in the connection between the connection terminal 1*a* and the spiral contact 20.

FIG. 4 is a sectional view of the elastically deforming portion 20*a* of the spiral contact 20 taken along Line 4 parallel to the width direction of the elastically deforming portion 20*a*, the sectional view being viewed in the direction indicated by an arrow.

With reference to FIG. 4A, an auxiliary elastic member 41 is disposed on a conductive member 40. The conductive member 40 is made of a material with a resistivity less than that of the auxiliary elastic member 41. The auxiliary elastic member 41 is made of a material having a yield point and elastic modulus greater than those of the conductive member 40.

Since the auxiliary elastic member 41 and the conductive member 40 are laminated together as shown in FIG. 4A, the spiral contacts 20 has good conductivity due to the presence of the conductive member 40 and also has good spring properties due to the presence of the auxiliary elastic member 41.

In FIG. 4A, the conductive member 40 may be disposed on the auxiliary elastic member 41.

In FIG. 4A, both the conductive member 40 and the auxiliary elastic member 41 may be formed by plating. Alternatively, the conductive member 40 may include a metal foil and the auxiliary elastic member 41 may be formed by plating.

With reference to FIG. 4B, the auxiliary elastic member 41, the conductive member 40, and a coating member 42 are arranged in that order. The coating member 42 is used to enhance hardness and abrasion resistance. The coating member 42 is made of a material with a resistivity less than that of the auxiliary elastic member 41 and preferably has a function of reducing the contact resistance between the electronic component and the contact.

FIG. 4C shows a configuration in which the upper surface, lower surface, and side surfaces of the conductive member 40 are entirely covered with the auxiliary elastic member 41. Since the conductive member 40 is entirely covered with the auxiliary elastic member 41, the spiral contact 20 has properly enhanced spring properties. This is preferable.

FIG. 4D shows a modification of the configuration shown in FIG. 4C. In the modification, the upper surface, lower surface, and side surfaces of the conductive member 40 are entirely covered with the auxiliary elastic member 41 and the auxiliary elastic member 41 is covered with the coating member 42.

The conductive member 40 is made of Cu or a Cu alloy. An example of the Cu alloy is a Corson alloy containing Cu, Si, and Ni. The auxiliary elastic member 41 is preferably made of Ni—X (wherein X is at least one of P, W, and B). When the conductive member 40 is made of Cu or the Cu alloy (other than the Corson alloy), the spiral contact 20 can be manufactured at low cost and has good conductivity. However, the conductive member 40 cannot be expected to have desired spring properties. Hence, it is necessary to select Ni—X for the auxiliary elastic member 41 such that the elastically deforming portion 20*a* has properly enhanced spring properties. If, for example, Ni is selected for the auxiliary elastic member 41, the auxiliary elastic member 41 cannot be expected to have effectively enhanced spring properties, that is, the auxiliary elastic member 41 has a large settling factor. In particular, a combination of Cu and Ni is inferior in spring properties to a combination of Cu and Ni—X. Therefore, in this embodiment, the auxiliary elastic member 41 is preferably made of Ni—X (wherein X is at least one of P, W, and B). The coating member 42 is made of one selected from Au, Ag, Pd, and Sn.

The auxiliary elastic member 41 is formed by plating as described above. An electroless plating process or an electroplating process may be used. In order to cover the conductive member 40 with the auxiliary elastic member 41 as shown in FIG. 4C or 4D, the auxiliary elastic member 41 is formed by the electroless plating process.

This embodiment is characterized in that the auxiliary elastic member 41 is amorphous. The auxiliary elastic member 41 is made of the Ni—X alloy as described above. The Ni—X alloy has a higher crystallization temperature as compared to Ni. The Ni—X alloy is not crystallized but is amorphous at the crystallization temperature of Ni. It is preferable that the auxiliary elastic member 41 be made of, for example, an NiP alloy and be formed by plating and the composition ratio of P be 15 atomic percent or more. When the composition ratio of P is 15 atomic percent or more, the precipitation of Ni crystals can be properly prevented, as compared to the case where the composition ratio of P is less than 15 atomic percent. The precipitation of the Ni crystals causes the auxiliary elastic member 41 to be brittle and significantly reduces spring properties of the auxiliary elastic member 41. This is not preferable. The composition ratio of P is preferably 30 atomic percent or less. This is because a brittle intermetallic compound such as NiP, $Ni_5P_2$, or $Ni_2P_5$ is produced when the composition ratio of P is greater than 30 atomic percent. When element X is W, the composition ratio of W preferably ranges from 14.5 to 36 atomic percent. This allows NiW to be formed in an amorphous state. The composition ratio of W is more preferably 20 atomic percent or more. When element X is B, the composition ratio of B is preferably 15 to 30 atomic percent. This allows NiB to be formed in an amorphous state.

The whole of the auxiliary elastic member 41 is most preferably amorphous (non-crystalline) and the auxiliary elastic member 41 may contain ultra-fine precipitates (embryos) with a diameter of, for example, 1 nm or less. The composition of the ultra-fine precipitates may be, for example, Ni, element X, or Ni—X. The ultra-fine precipitates have a size corresponding to a cluster of several particles and are not crystalline. Although the ultra-fine precipitates are present, the auxiliary elastic member 41 has proper amorphous characteristics. This embodiment does not exclude such a state that crystals are partly precipitated. In a state shown in FIG. 5, an amorphous phase 50 is predominant and the embryos 51 and crystals 52 are present. The crystals 52 have a diameter (a maximum size) of about 3 to 15 nm. The crystals 52 are not made of Ni but are preferably intermetallic compound crystals made from Ni—X. When the auxiliary elastic member 41 is made of the NiP alloy, the composition of the crystals 52 is $Ni_3P$. Ni crystals cause films to be very brittle. Although the intermetallic compound crystals are precipitated, spring properties can be prevented from being reduced, as compared to the precipitation of the Ni crystals. The intermetallic compound crystals 52 are precipitated as shown in FIG. 5, the crystals 52 are covered with the amorphous phase 50 and the amorphous phase 50 is predominant. The amorphous phase 50 preferably occupies 60 to 100 volume percent of the auxiliary elastic member 41. That is, this embodiment includes a state that the auxiliary elastic member 41 is entirely amorphous, a state that the auxiliary elastic member 41 contains the amorphous phase and the ultra-fine precipitates, a state that the auxiliary elastic member 41 contains the amorphous phase, the ultra-fine precipitates, and crystals (which are preferably intermetallic compound crystals) and the amorphous phase occupies 60 volume percent or more of a film. The amorphous phase preferably occupies 80 volume percent or more of the film and more preferably 90 volume percent or more. These states are herein collectively referred to as "an amorphous state". Among the above three states, the state that the auxiliary elastic member 41 is entirely amorphous is most preferable. The state that the auxiliary elastic member 41 contains the amorphous phase and the ultra-fine precipitates is next to that state.

Since the elastically deforming portion 20*a* of each spiral contact 20 includes the auxiliary elastic member 41 and the auxiliary elastic member 41 is formed in an amorphous state, the elastically deforming portion 20*a* has a yield point greater than that of conventional elastically deforming portions. In particular, the auxiliary elastic member 41 has such a yield point that the load applied thereto is 19.6 mN or more and the distortion thereof is 0.1 mm or more. Since the auxiliary elastic member 41 is amorphous, the auxiliary elastic member 41 has high cracking resistance (breaking resistance) and the spiral contact 20 can be three-dimensionally shaped so as to have a predetermined height. Furthermore, even if the inspection device 10 is repeatedly used, the settling factor of the spiral contact 20 is less than that of conventional one.

As shown in FIG. 3, the elastically deforming portion 20*a* of the spiral contact 20 is three-dimensionally shaped so as to spirally extend upward. Three-dimensional shaping is performed under heating conditions. In conventional elastically deforming portions 20 including auxiliary elastic members 41 made of Ni, there is a problem in that spring properties of the conventional elastically deforming portions are impaired because Ni in the auxiliary elastic members is crystallized by heating. However, in this embodiment, the auxiliary elastic member 41 is made of the Ni—X alloy and therefore is amorphous. This allows the auxiliary elastic member 41 to have enhanced spring properties as described for the yield point.

The percentage of the cross-sectional area of the auxiliary elastic member 41 in the cross-sectional area shown in FIG. 4 is preferably 30% or more and more preferably 50% or more, wherein the percentage is determined by the formula {(cross-sectional area of auxiliary elastic member 41/total cross-sectional area)×100(%)}. This allows spring properties to be enhanced and allows the settling factor to be properly reduced.

In this embodiment, the elastically deforming portion 20*a* is three-dimensionally shaped (substantially conically shaped) so as to extend upward. Three-dimensional shaping is performed under heating conditions. Therefore, even if the elastically deforming portion 20*a* is repeatedly used, the conformation thereof can be maintained and therefore the elastically deforming portion 20*a* can be brought into good contact with the connection terminal 1*a*. Furthermore, in this embodiment, although the elastically deforming portion 20*a* is heated during formation or heat-treated in a burn-in test or the like, the elastically deforming portion 20*a* is maintained in an amorphous state.

Unlike the auxiliary elastic member 41, the conductive member 40 need not be amorphous but may be predominantly crystalline. In order to allow the conductive member 40 to have good conductivity, the conductive member 40 is preferably crystalline.

A method for manufacturing the spiral contacts 20 will now be described. FIGS. 6 to 8 are illustrations showing steps of the manufacturing method of the spiral contacts 20 and illustrate a procedure in which the spiral contacts 20 are mounted on the base 11 and the elastically deforming portions 20*a* of the spiral contacts 20 are then three-dimensionally shaped so as to extend upward.

As shown in FIG. 6, the base 11 has the through-holes 11*a* and conductive portions 60 surrounding the through-holes 11*a*. The conductive portions 60 are made of a conductive material and can be formed by sputtering. The spiral contacts 20 have the base portions 21 and the elastically deforming portions 20*a* extending from the base portions 21 as described above. The spiral contacts 20 have, for example, a configuration in which each conductive member 40 including a copper foil is covered with each auxiliary elastic member 41 formed by electroless plating using an NiP alloy (FIG. 4(C)). The elastically deforming portions 20*a* have a spiral shape. The base portions 21 of the spiral contacts 20, of which the number is large, are supported with a resin sheet 71, made of polyimide or the like, for preventing the spiral contacts 20 from being scattered. The resin sheet 71, as well as the base 11, has through-holes that are located at positions opposed to the elastically deforming portions 20*a* in the height direction.

The spiral contacts 20, which are supported with the resin sheet 71, are placed onto the base 11. In this operation, the elastically deforming portions 20*a* of the spiral contacts 20 are aligned with the through-holes 11*a* of the base 11 such that the elastically deforming portions 20*a* are coincident with the through-holes 11*a* in the height direction. The elastically deforming portions 20*a* of the spiral contacts 20 are fixed to regions surrounding the through-holes 11*a* of the base 11 with the conductive adhesive 61. This allows the base portions 21 to be electrically connected to the conductive portions 60 with the conductive adhesive 61.

As shown in FIG. 6, projection-adjusting members 70 are put into the through-holes 11*a* from beneath the spiral contacts 20. The projection-adjusting members 70 are then pressed upward.

As shown in FIG. 7, the elastically deforming portions 20*a* of the spiral contacts 20 are pressed upward because the projection-adjusting members 70 are pressed upward. In this step, the projection-adjusting members 70 are pressed upward while the elastically deforming portions 20*a* are being heat-treated. After a predetermined time has elapsed, the projection-adjusting members 70 are removed (FIG. 8).

Since the elastically deforming portions 20*a* are three-dimensionally shaped while being heat-treated, the elastically deforming portions 20*a* remain extending upward after the projection-adjusting members 70 are removed.

As shown in FIG. 7, each projection-adjusting member 70 is pressed upward such that the height from the upper surface 21*a* of the base portion 21 of each spiral contact 20 to the top A of the elastically deforming portion 20*a* of the spiral contact 20 is equal to H1. The state shown in FIG. 7 is kept under heating conditions. As shown in FIG. 8, after the projection-adjusting member 70 is removed, the height of the elastically deforming portion 20*a* is reduced from H1 to H2 on the basis of the upper surface 21*a* of the base portion 21 of the spiral contact 20 because of spring-back. Therefore, the height H1 of the elastically deforming portion 20*a* pressed with the projection-adjusting member 70 upward needs to be set greater than the actually necessary height H2 of the elastically deforming portion 20*a* in anticipation of spring-back. The elastically deforming portions 20*a* are three-dimensionally shaped under heating conditions as described above. In this embodiment, the auxiliary elastic members 41 of the elastically deforming portions 20*a* are made of the Ni—X alloy and therefore have a crystallization temperature higher than that of Ni. Hence, after the elastically deforming portions 20*a*, as well as conventional ones, are three-dimensionally shaped by heating the elastically deforming portions 20*a* at a temperature of about 200° C. to 300° C., the auxiliary elastic members 41 are maintained in an amorphous state because the crystallization temperature of the auxiliary elastic members 41 is lower than the heating temperature of the elastically deforming portions 20*a*.

In this embodiment, although the elastically deforming portions 20*a* are three-dimensionally shaped by heating, the auxiliary elastic members 41 can be maintained in an amorphous state. Therefore, the elastically deforming portions 20*a* can be three-dimensionally deformed in such a manner that stresses in the plastic region of the auxiliary elastic members 41 are applied to the elastically deforming portions 20*a* during three-dimensional shaping. Since the elastically deforming portions 20*a* are deformed in the plastic region of the auxiliary elastic members 41, fixed dislocations can be generated in the auxiliary elastic members 41. The energy required to generate the fixed dislocations is less than the energy required to convert mobile dislocations into the fixed dislocations during the deformation of elastically deforming portions 20*a* in the plastic region of the auxiliary elastic members 41. Hence, in this embodiment, the heating time of the elastically deforming portions 20*a* may be short. Whereas the heating time of conventional elastically deforming portions is about one hour, the heating time of the elastically deforming portions 20*a* is several to several ten minutes. Although the heating time of the elastically deforming portions 20*a* is shorter than that of conventional ones, the spiral contacts 20 can be manufactured so as to have a small settling factor. If the auxiliary elastic members 41 are made of Ni as used to be, the elastically deforming portions 20*a* manufactured have very poor spring properties, because Ni is crystallized when the elastically deforming portions 20*a* are three-dimensionally shaped by applying stresses in the plastic region to the elastically deforming portions 20*a*. Therefore, conventional elastically deforming portions need to be three-dimensionally shaped by applying stresses in the elastic region to the conventional elastically deforming portions. The energy required to convert mobile dislocations in the conventional elastically deforming portions into fixed dislocations is very large; hence, the heating time of the conventional elastically deforming portions needs to be long. However, in this embodiment, the heating time of the elastically deforming portions 20*a* may be short as described above and therefore can be readily manufactured.

If the elastically deforming portions 20*a* of the spiral contacts 20 are not three-dimensionally shaped but the spiral contacts 20 are used in a flat form (the form shown in FIG. 6), the spiral contacts 20 are inevitably heated when the connection device 10 shown in FIG. 1 is used for a burn-in tester. In this embodiment, since the auxiliary elastic members 41 of the elastically deforming portions 20*a* of the spiral contacts 20 can be maintained in an amorphous state, good spring properties of the elastically deforming portions 20*a* can be maintained and the connection device 10 has high durability.

The elastically deforming portions 20*a* of the spiral contacts 20 may have a form other than a spiral form. When the elastically deforming portions 20*a* have a spiral form, the elastically deforming portions 20*a* can be deformed so as to cover the connection terminals 1*a* of the electronic component 1 even if the connection terminals 1*a* have any form. This allows the contact area between each elastically deforming portion 20*a* and connection terminal 1*a* to be large enough to secure the contact between the elastically deforming portion 20*a* and the connection terminal 1*a*. Therefore, the elastically deforming portions 20*a* preferably have a spiral form.

In this embodiment, the auxiliary elastic members 41 are preferably made of Ni—X (wherein X is at least one of P, W, and B). When element X is P, the composition ratio of P is preferably 15 to 30 atomic percent. When element X is W, the composition ratio of W is preferably 14.5 to 36 atomic percent and more preferably 20 atomic percent or more. When element X is B, the composition ratio of B is preferably 15 to 30 atomic percent.

The auxiliary elastic members 41 have a higher crystallization temperature as compared to the case where the auxiliary elastic members 41 are made of Ni. The heating temperature for three-dimensional shaping is about 200° C. to 300° C. and is lower than the crystallization temperature. Even if the elastically deforming portions 20*a* are three-dimensionally shaped by heating the auxiliary elastic members 41, the auxiliary elastic members 41 can be maintained in an amorphous state. In particular, if the auxiliary elastic members 41 are made of NiW and heated to about 700° C., the heating temperature thereof is lower than the crystallization temperature thereof. Therefore, the auxiliary elastic members 41 can be maintained in an amorphous state. Since the allowance of the heating temperature can be increased, the elastically deforming portions 20*a* can be three-dimensionally shaped properly and readily.

A technique for three-dimensionally shaping the elastically deforming portions 20*a* is not limited to a technique in which the elastically deforming portions 20*a* are heat-treated in such a manner that the elastically deforming portions 20*a* are pressed upward with the projection-adjusting members 70 shown in FIG. 6. The elastically deforming portions 20*a* may be three-dimensionally shaped in such a manner that the elastically deforming portions 20*a* are formed on conical bases, separated from the bases, and then heat-treated or in such a manner that the elastically deforming portions 20*a* are formed on the bases, heat-treated, and then separated from the bases.

The elastically deforming portions 20*a* of the spiral contacts 20 of this embodiment need not have any one of the multilayer structures shown in FIG. 4 and may include the auxiliary elastic members 41 only. In this case, the elastically deforming portions 20*a* are preferably globally amorphous.

The Ni—X alloy, which is a material for forming the auxiliary elastic members 41, is for illustrative purposes only. The auxiliary elastic members 41 may be made of another material.

EXAMPLES

FIG. 9 (a comparative example) and FIG. 10 (a comparative example) are TEM photographs of an NiP alloy containing 12.5 atomic percent P. In particular, FIG. 9 is a TEM photograph of the NiP alloy which was plated and was not heated. FIG. 10 is a TEM photograph of the NiP alloy which was plated and then heated at 250° C. for one hour.

The analysis of the TEM photograph shown in FIG. 9 showed that $Ni_3P$ intermetallic compound crystals were predominant and fine Ni crystals were present between the intermetallic compound crystals.

The analysis of the TEM photograph shown in FIG. 10 showed that $Ni_3P$ intermetallic compound crystals were predominant and fine Ni crystals and Ni single-crystals were present between the intermetallic compound crystals.

FIG. 11 (an example), FIG. 12 (an example), and FIG. 13 (an example) are TEM photographs of an NiP alloy containing 19 atomic percent P. In particular, FIG. 11 is a TEM photograph of this NiP alloy which was plated and was not heated. FIG. 12 is a TEM photograph of this NiP alloy which was plated and then heated at 250° C. for 36 minutes. FIG. 13 is a TEM photograph of this NiP alloy which was plated and then heated at 250° C. for one hour.

The analysis of the TEM photograph shown in FIG. 11 showed that no crystal was present and this NiP alloy was amorphous.

The analysis of the TEM photograph shown in FIG. 12 showed that although the TEM photograph shown in FIG. 12 was not remarkably different from that in FIG. 11, ultra-fine precipitates (embryos) with a size of 1 nm or less were present.

The analysis of the TEM photograph shown in FIG. 13 showed that precipitates of an intermetallic compound were partly present. The intermetallic compound was $Ni_3P$ and Ni crystals were not present. As shown in FIG. 13, the intermetallic compound precipitates are present in an amorphous phase. This means that this NiP alloy is maintained in an amorphous state.

FIG. 14 (an example) is a TEM photograph of a composite member which was prepared in such a manner that a copper substrate is plated with an NiP alloy containing 15 atomic percent P by an electroless plating process and which was heat-treated at 250° C. for one hour. As shown in FIG. 14, the copper substrate is crystalline and a coating of the NiP alloy contains no crystalline grains. That is, the NiP alloy coating is amorphous.

FIG. 15 includes X-ray diffraction patterns of a plurality of composite members (a) to (j) which were prepared by plating Cu substrates with NiP alloys having different P composition ratios and which were heated at 250° C. for one hour.

As shown in FIG. 15, the composite members (a) to (d) with a P composition ratio of 7.9 to 14.7 atomic percent each have a peak corresponding to the Ni {111} plane. The composite member with a P composition ratio of 16.1 atomic percent has a small peak supposed to correspond to the Ni {111} plane. This small peak is probably due to ultra-fine precipitates (embryos) with a size of 1 nm. This composite member is not crystalline. The experiment results shown in FIGS. 9 to 15 show that in order to maintain an NiP alloy in an amorphous state, this NiP alloy needs to have a P concentration of 15 atomic percent or more.

A copper foil for forming a spiral contact was plated with an NiP alloy by an electroless plating process. This NiP alloy had a P composition ratio of 19 atomic percent. A stress was applied to an elastically deforming portion of the spiral contact. In the same manner as that shown in FIG. 7, the elastically deforming portion 20*a* was heat-treated while the elastically deforming portion 20*a* was being deformed upward with a projection-adjusting member 70 (three-dimensional shaping). Heating conditions were as follows: a heating temperature of 250° C. and a heating time of one hour.

In this experiment, as shown in FIG. 16, the stress applied to the elastically deforming portion of the spiral contact was varied such that the height of the elastically deforming portion was varied. The term "height of projection-adjusting member" in the graph of FIG. 16 means the height H3 from the upper surface 21*a* of the base portion 21 of the spiral contact 20 to the tip of the projection-adjusting member 70 shown in FIG. 1. The stress applied to the elastically deforming portion increases with an increase in the height H3. The term "post-forming height" in the graph of FIG. 16 means the height H2 from the upper surface 21*a* of the base portion 21 of the spiral contact 20 separated from the projection-adjusting member 70 to the top A of the elastically deforming portion 20*a* shown in FIG. 8.

After the elastically deforming portion 20*a* was formed (three-dimensionally shaped), a stress was applied to the elastically deforming portion 20*a* downward (in such a direction that the state shown in FIG. 8 was switched to the state shown in FIG. 6) such that the upper surface of the elastically deforming portion 20*a* of the spiral contact 20 became flush with the upper surface of the base portion 21 (the spiral contact 20 became flat) as shown in FIG. 6. The resulting elastically deforming portion 20*a* was maintained at 150° C. for 48 hours under heating conditions (burn-in: BI). After the stress was removed from the elastically deforming portion 20*a*, the elastically deforming portion 20*a* was deformed upward. The height of the elastically deforming portion 20*a* deformed upward was defined as "post-BI height" as shown in the graph of FIG. 16. The term "post-BI height", as well as the term "post-forming height", means the height from the upper surface 21*a* of the base portion 21 of the spiral contact 20 to the top A of the elastically deforming portion 20*a*.

FIG. 17 illustrates that although the stress applied to the elastically deforming portion 20*a* during three-dimensional shaping is varied, the settling factor of the elastically deforming portion 20*a* can be suppressed to 30% or less, wherein the settling factor (%) is defined by the formula {((post-forming height)−(post-BI height))/(post-forming height)}×100. The increase of the settling factor proves that the elastically deforming portion 20*a* is being plastically deformed gradually; hence, the settling factor needs to be small.

As shown in FIG. 16, if a stress greater than 1440 MPa is applied to the NiP alloy, the NiP alloy is three-dimensionally shaped in the plastic region thereof. On the other hand, if a stress less than 1440 MPa is applied to the NiP alloy, the NiP alloy is three-dimensionally shaped in the elastic region thereof. Settling probably occurs due to mobile dislocations. In order to allow the elastically deforming portion 20*a* to have a small settling factor, the mobile dislocations need to be converted into fixed dislocations when the elastically deforming portion 20*a* is three-dimensionally shaped.

If the NiP alloy is three-dimensionally shaped in the elastic region thereof, a large amount of energy is required to convert the mobile dislocations into the fixed dislocations. In order to three-dimensionally shape the elastically deforming portion 20*a* with a stress of 1440 MPa or less, the elastically deforming portion 20*a* needs to be heated for a long time such that the mobile dislocations are converted into the fixed dislocations. If the NiP alloy is three-dimensionally shaped in the plastic region thereof, the mobile dislocations can be converted into the fixed dislocations with a small amount of energy because the NiP alloy is plastically deformed. Therefore, if the NiP alloy is three-dimensionally shaped in the plastic region, the elastically deforming portion 20*a* can be formed so as to have a small settling factor, although the heating time of the NiP alloy three-dimensionally shaped in the plastic region is shorter than that of the NiP alloy three-dimensionally shaped in the elastic region.

FIG. 16 is a graph showing properties of an elastically deforming portion 20*a* containing an amorphous NiP alloy. The use of the amorphous NiP alloy reduces the heating time.

The following contacts were prepared: spiral contacts (that is, spiral contacts including copper foils electrolessly plated with an NiP alloy containing 15 atomic percent P) having the same configuration as that of the spiral contact used in the experiment shown in FIG. 16. In the experiment shown in FIG. 18, an elastically deforming portion of one of the spiral contacts was three-dimensionally shaped as shown in FIG. 7 or 8 in such a manner that the elastically deforming portion was heated at 200° C. for 72 hours. In the experiment shown in FIG. 19, an elastically deforming portion of another one of the spiral contacts was three-dimensionally shaped as shown in FIG. 7 or 8 in such a manner that this elastically deforming portion was heated at 250° C. for 36 minutes. In the experiment shown in FIG. 20, an elastically deforming portion of another one of the spiral contacts was three-dimensionally shaped as shown in FIG. 7 or 8 in such a manner that this elastically deforming portion was heated at 250° C. for nine minutes. A stress of 2500 MPa was applied to each of the elastically deforming portions when the elastically deforming portions were three-dimensionally shaped. The elastically deforming portions of the spiral contacts were measured for "post-forming height" (post-three-dimensional shaping height). In the experiments shown in one FIGS. 18 to 20, the elastically deforming portions 20*a* were heated at 150° C. for 24 hours while a stress was being applied to each elastically deforming portion 20*a* such that the elastically deforming portion 20*a* was in the state shown in FIG. 6 (burn-in 1). This stress was removed from the elastically deforming portion 20*a*, whereby the elastically deforming portion 20*a* was deformed as shown in FIG. 8. The resulting elastically deforming portion 20*a* was measured for height. The height of the elastically deforming portion 20*a* in this state was defined as "post-BI height 1". The elastically deforming portion 20*a* was heated at 150° C. for 48 hours again while a stress was being applied to the elastically deforming portion 20*a* such that the elastically deforming portion 20*a* was in the state shown in FIG. 6 (burn-in 2). This stress was removed from the elastically deforming portion 20*a*, whereby the elastically deforming portion 20*a* was deformed as shown in FIG. 8. The resulting elastically deforming portion 20*a* was measured for height. The height of the elastically deforming portion 20*a* in this state was defined as "post-BI height 2". "Post-forming height", "post-BI height 1", and "post-BI height 2" were determined in such a manner that the height from the upper surface 21*a* of a base portion 21 of each spiral contact 20 to the top A of the elastically deforming portion 20*a* was measured.

The settling factor of each spiral contact was determined by the formula {((post-forming height)−(post-BI height 1 or 2)/(post-forming height)}×100. The experiment results are shown in FIGS. 18 to 20.

As shown in FIGS. 18 to 20, in all the experiments, the spiral contacts have a settling factor of 30% or less. In the experiment shown in FIG. 20, although the heating time for three-dimensional shaping is only nine minutes, the spiral contact of this experiment has a settling factor of 30% or less. This shows that a spiral contact with a settling factor of 30% or less can be manufactured even if the heating time thereof is reduced to several to several ten minutes, although conventional spiral contacts are heated for about one hour.

In the experiment, shown in FIG. 21, providing a comparative example, a spiral contact was prepared in such a manner that a copper foil was coated with an NiP alloy having a P composition ratio of 12.5 atomic percent by an electroless plating process. In the experiment, shown in FIG. 22, providing an example, a spiral contact was prepared in such a manner that a copper foil was coated with an NiP alloy having a P composition ratio of 19 atomic percent by an electroless plating process. In the comparative example and the example, the spiral contacts were three-dimensionally shaped in such a manner that the spiral contacts were heated at 250° C. for one hour. An elastically deforming portion of each spiral contact was measured for distortion in such a manner that a load was applied to the elastically deforming portion until the spiral contact is broken. The term "distortion" means the downward travel distance H4 from the top A of the elastically deforming portion of the spiral contact in the state (an unloaded state) shown in FIG. 8 to the top A' of the elastically deforming portion that has been moved downward by applying the load to the elastically deforming portion (see FIG. 8).

FIG. 21 shows the example and FIG. 22 shows the comparative example. The NiP alloy used in the experiment shown in FIG. 21 has a P composition ratio of 12.5 atomic percent and therefore is crystallized by heating during three-dimensional shaping. In contrast, the NiP alloy used in the experiment shown in FIG. 22 has a P composition ratio of 15 atomic percent and therefore is maintained in an amorphous state although the NiP alloy was heated during three-dimensional shaping. In the comparative example shown in FIG. 21, the elastically deforming portion of the spiral contact was broken when the distortion of the elastically deforming portion was increased to 250 μm. In the example shown in FIG. 22, the elastically deforming portion of the spiral contact was not broken when the distortion of the elastically deforming portion was increased to 500 μm or more.

In the experiment shown in FIG. 23, a large number of spiral contacts were prepared in such a manner that copper foils were coated with an NiP alloy having a P composition ratio of 12.5 atomic percent by an electroless plating process. The spiral contacts were three-dimensionally shaped in such a manner that the spiral contacts were heated at 250° C. for one hour. A projecting member for testing was placed above an elastically deforming portion of each spiral contact. The elastically deforming portion was pressed by moving the projecting member downward such that a stress of 1000 to 1500 MPa was applied to the elastically deforming portion. The projecting member was moved upward to its original position. The projecting member was moved downward and upward 3000 times. The following percentage was investigated (a life test): the percentage of the elastically deforming portions of the spiral contacts that were broken until the projecting member was moved downward and upward 1000 or 3000 times. As shown in FIG. 23, the percentage of the broken elastically deforming portions decreases with a decrease in the stress applied to each elastically deforming portion. About 80% of the elastically deforming portions were broken until a stress of about 1500 MPa was applied to each elastically deforming portion 3000 times. Some of the elastically deforming portions were broken until the projecting member was moved downward and upward 1000 times.

This shows that the percentage of the broken elastically deforming portions cannot be reduced to 0%. That is, since the NiP alloy in the elastically deforming portions is crystallized, the spiral contacts have low durability.

The spiral contacts, shown in FIG. 16 or 17, three-dimensionally shaped by applying a stress to the spiral contacts, that is, the spiral contacts including the copper foils coated with the amorphous NiP alloy (a P content of 15 atomic percent) by the electroless plating process were not broken until a stress of 2000 MPa was applied to the spiral contacts 4000 times. This shows that the use of the amorphous NiP alloy for the elastically deforming portions greatly enhances the durability thereof.

The following spiral contacts were investigated for yield point: the spiral contact (three-dimensionally shaped at a heating temperature of 200° C. for 72 hours in Example 1), used in the experiment shown in FIG. 18, including the auxiliary elastic member made of the NiP alloy having a P composition ratio of 15 atomic percent; the spiral contact (three-dimensionally shaped at a heating temperature of 250° C. for 36 minutes in Example 2), used in the experiment shown in FIG. 19, including the auxiliary elastic member made of the NiP alloy having a P composition ratio of 15 atomic percent; a spiral contact, three-dimensionally shaped at a heating temperature of 250° C. for 18 minutes (in Example 3), including an auxiliary elastic member made of the NiP alloy having a P composition ratio of 15 atomic percent; and the spiral contact (three-dimensionally shaped at a heating temperature of 250° C. for nine minutes in Example 4), used in the experiment shown in FIG. 20, including the auxiliary elastic member made of the NiP alloy having a P composition ratio of 15 atomic percent.

In this experiment, the following load and distance were investigated: the load applied to the elastically deforming portion of each three-dimensionally shaped spiral contact at its yield point and the downward travel distance H4 (the distortion) of the top A of the elastically deforming portion of the spiral contact, the elastically deforming portion being pressed downward (see FIG. 8). The experiment results were shown in Table 1.

TABLE 1

| Samples | Spring constant (gf/mm) | Yield point Load (gf) | Yield point Distortion (mm) |
|---|---|---|---|
| Example 1 | 21.4 | 4.2 | 0.233 |
| Example 2 | 22.2 | 4.3 | 0.223 |
| Example 3 | 21.8 | 4.2 | 0.229 |
| Example 4 | 21.4 | 4.1 | 0.224 |

The spiral contacts of the examples are not significantly different in load and distortion at yield point from each other. As shown in Table 1, each spiral contact has such a yield point that the load applied thereto is 2 gf (19 mN) or more and the distortion thereof is 0.1 mm or more. The spiral contact preferably has such a yield point that the load applied thereto is 4 gf (38 mN) or more and the distortion thereof is 0.2 mm or more.

FIG. 24 includes X-ray diffraction patterns of composite members (k) to (p), heated at 250° C. for one hour, including Cu substrates plated with NiW alloys having different W composition ratios.

As shown in FIG. 24, the composite member with a W composition ratio of 12.5 atomic percent has a peak corresponding to the Ni {111} plane. The composite members with a W composition ratio of 14.9 or 19.7 atomic percent each have a small peak supposed to correspond to the Ni {111} plane. However, these composite members are predominantly amorphous as described below with reference to TEM photographs thereof. The composite members with a W composition ratio of 24.4, 27.7, or 35.1 atomic percent have no peak corresponding to the Ni {111} plane.

FIG. 25 includes a TEM photograph and transmission electron diffraction image of an NiW alloy, heated at 250° C. for one hour, containing 12.5 atomic percent W. FIG. 26 includes a TEM photograph and transmission electron diffraction image of an NiW alloy, heated at 250° C. for one hour, containing 14.9 atomic percent W. FIG. 27 includes a TEM photograph and transmission electron diffraction image of an NiW alloy, heated at 250° C. for one hour, containing 19.7 atomic percent W. FIG. 28 includes a TEM photograph and transmission electron diffraction image of an NiW alloy, heated at 250° C. for one hour, containing 24.4 atomic percent W. Each transmission electron diffraction image was obtained in such a manner that each NiW alloy was cut in the thickness direction thereof and an electron beam was applied perpendicularly to a cross section thereof.

The TEM photograph in FIG. 25 shows no amorphous portion but shows clear lattice fringes extending in the same direction. The transmission electron diffraction image thereof shows the diffraction mottle of a reciprocal-lattice plane. This suggests the presence of crystals. The indexing of the reciprocal-lattice plane shows that Ni crystals are predominant.

The TEM photograph in FIG. 26 shows lattice fringes with a spacing of 5 to 10 nm. These lattice fringes extend in random directions. This suggests the precipitation of crystals (or ultra-fine precipitates) from an amorphous phase. The transmission electron diffraction image in FIG. 26 has haloing, which suggests the presence of an amorphous portion. Therefore, the NiW alloy shown in FIG. 26 is predominantly amorphous.

The TEM photograph in FIG. 27 shows lattice fringes with a spacing of 4 to 6 nm. These lattice fringes extend in random directions. This suggests the precipitation of crystals (or ultra-fine precipitates) from an amorphous phase. The transmission electron diffraction image in FIG. 27 has haloing, which suggests the presence of an amorphous portion. FIG. 27 is clearer in haloing than FIG. 26. Therefore, the NiW alloy shown in FIG. 27 is more amorphous than the NiW alloy shown in FIG. 26.

The TEM photograph in FIG. 28 shows lattice fringes with a spacing of 5 nm or less. These lattice fringes are smaller than those shown in FIG. 26 or 27. The transmission electron diffraction image in FIG. 28 has very clear haloing. Therefore, the NiW alloy shown in FIG. 28 is more amorphous than the NiW alloy shown in FIG. 26 or 27.

The experiment results shown in FIGS. 24 to 28 show that an NiW alloy preferably has a W composition ratio of 14.5 to 36 atomic percent, more preferably 20 atomic percent or more, and further more preferably 24.4 atomic percent or more. This allows this NiW alloy to be maintained in an amorphous state.

FIG. 29 includes X-ray diffraction patterns of composite members, heated at different temperatures, including Cu substrates plated with NiP containing 19.7 atomic percent W.

FIG. 30 includes X-ray diffraction patterns of composite members, heated at different temperatures, including Cu substrates plated with NiP containing 27.7 atomic percent W.

As shown in FIG. 29, the composite members, heat-treated at about 600° C., having a W composition ratio of 19.7 atomic percent each have a peak corresponding to the Ni {111} plane. As shown in FIG. 30, the composite member, heat-treated at about 700° C., having a W composition ratio of 27.7 atomic percent has a peak corresponding to the Ni {111} plane.

As described above, an increase in the composition ratio of W prevents crystallization regardless of an increase in heat treatment temperature. NiW can be prevented from being crystallized depending on its W composition ratio even if the heat-treating temperature thereof is increased to about 700° C. Therefore, the allowance of the heat treatment temperature is large and NiW can be effectively maintained in an amorphous state.

BRIEF DESCRIPTION THE DRAWINGS

FIGS. 4A, 4B, 4C, and 4D are sectional views of contact pieces included in spiral contacts according to an embodiment, the sectional views being obtained by cutting the contact pieces in the thickness direction along the width direction.

Figure 1:
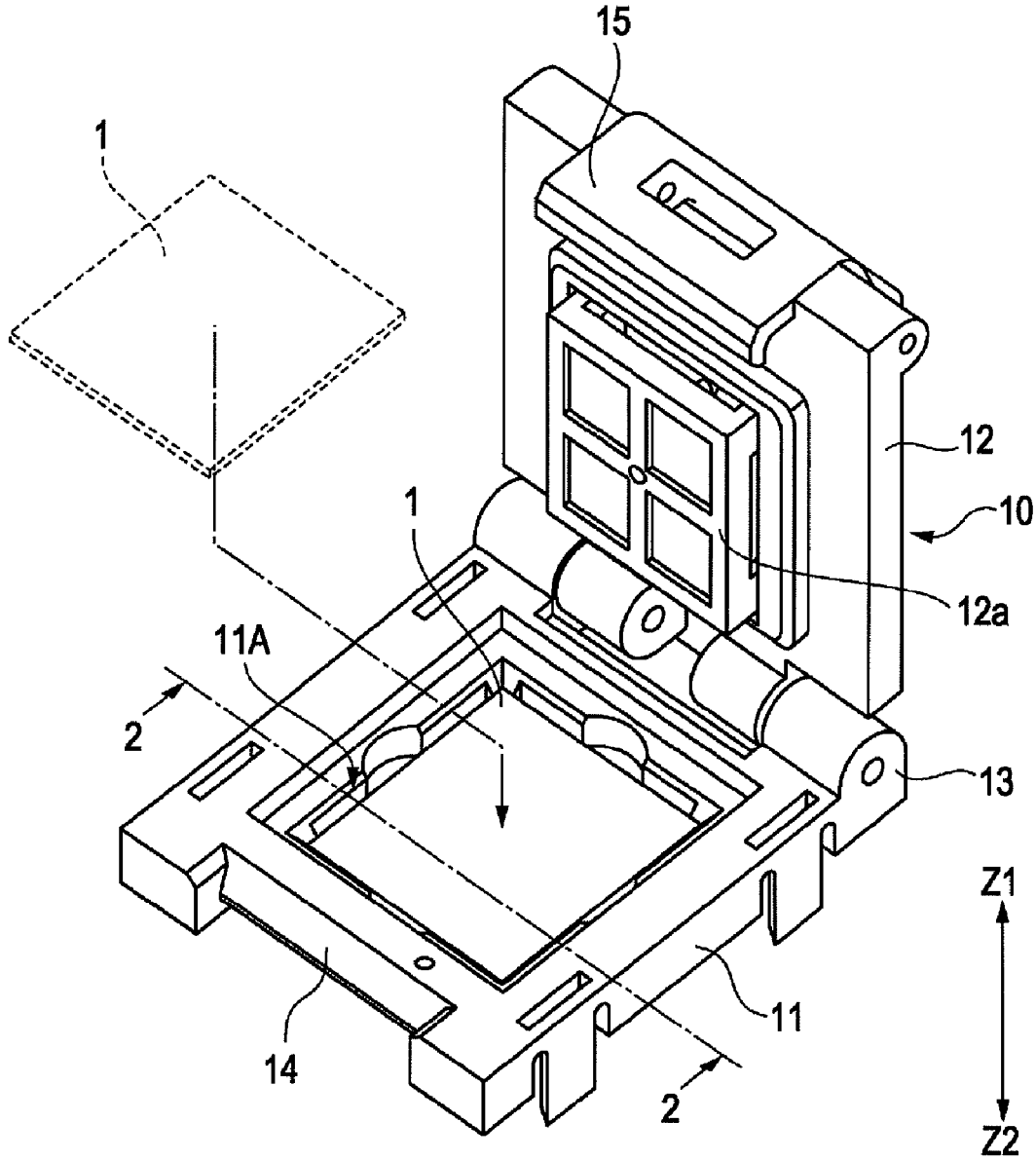
FIG. 1 is a perspective view of an inspection device used for a test for checking the operation of electronic components.
Figure 2:
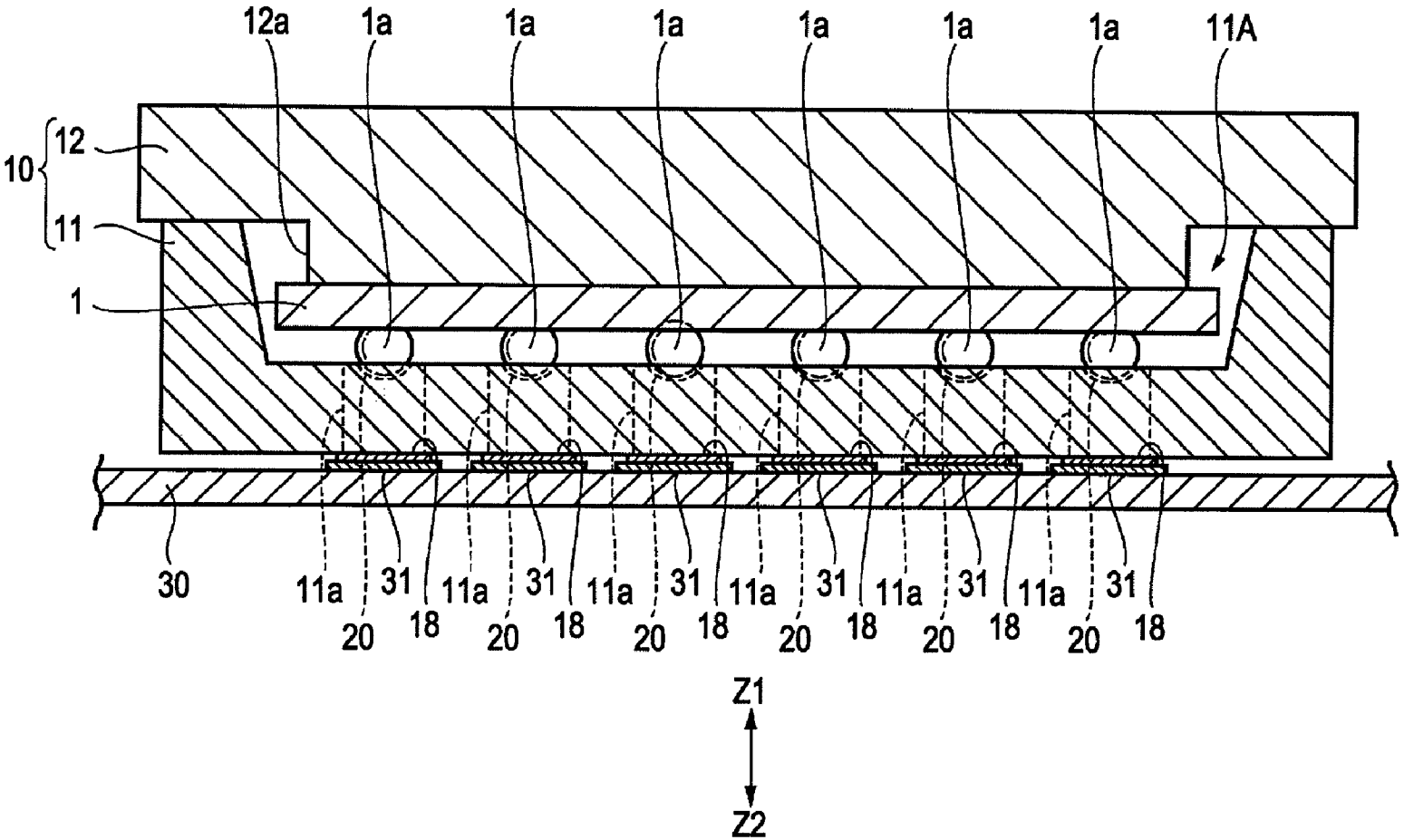
FIG. 2 is a sectional view of the inspection device, connected to an electronic component, taken along the line 2-2 of FIG. 1.
Figure 3:
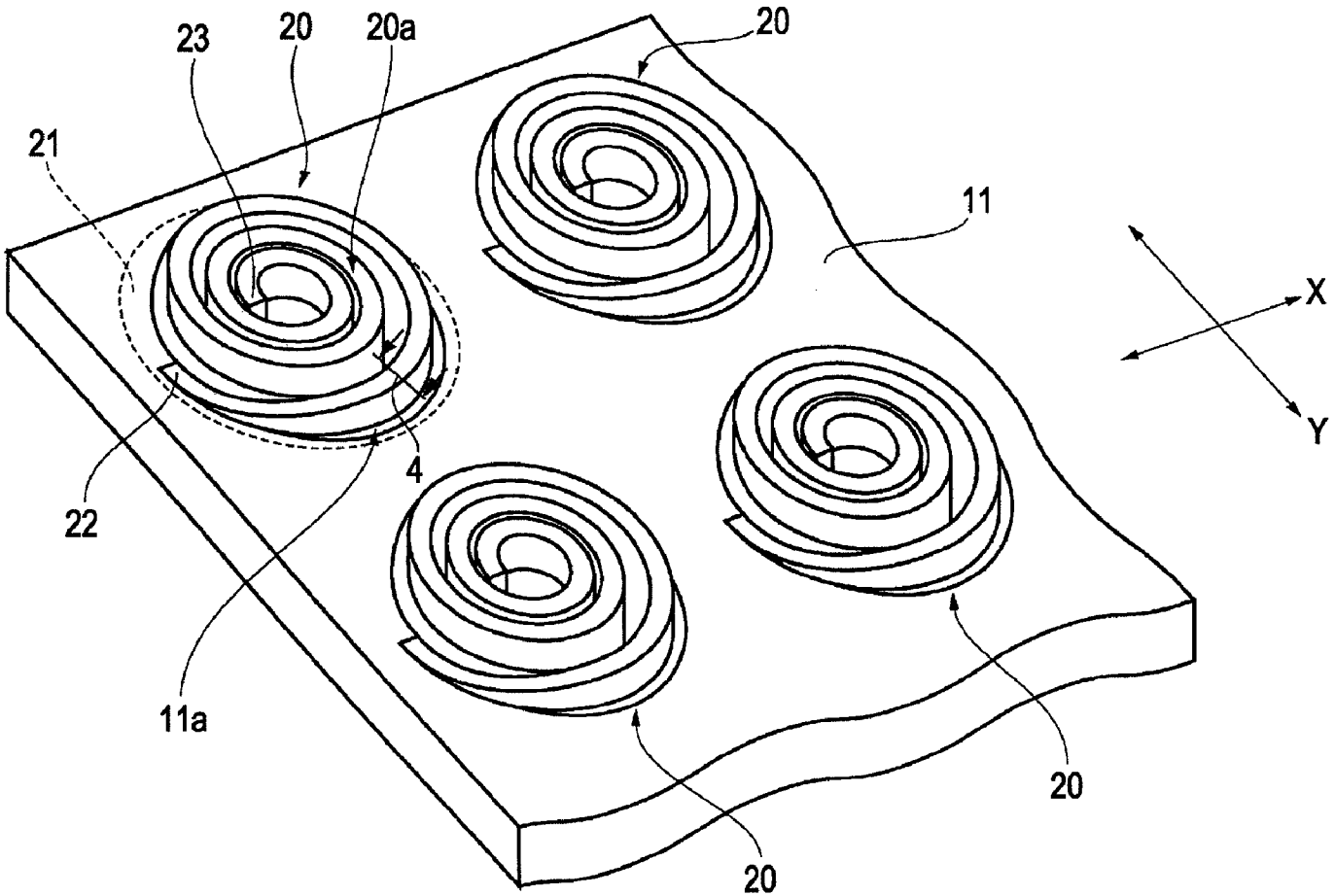
FIG. 3 is an enlarged perspective view showing spiral contacts according to an embodiment.
Figure 4:
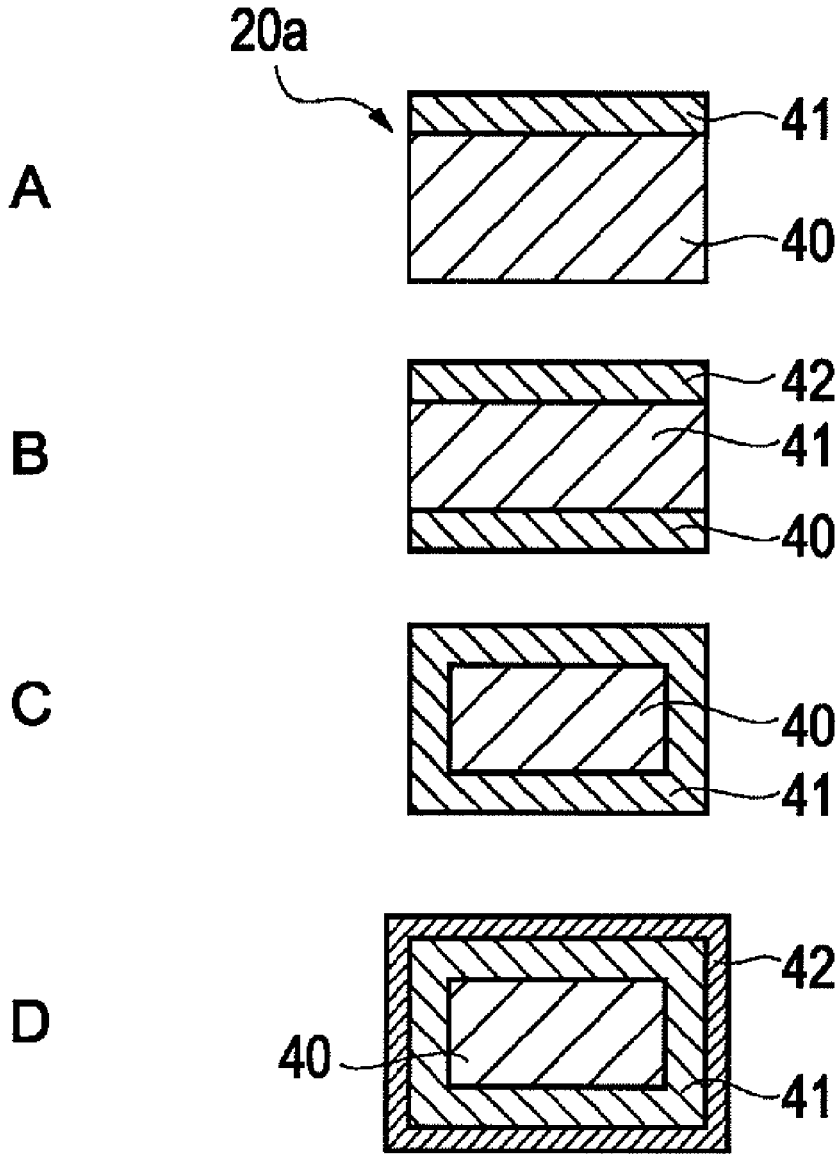
Figure 5:
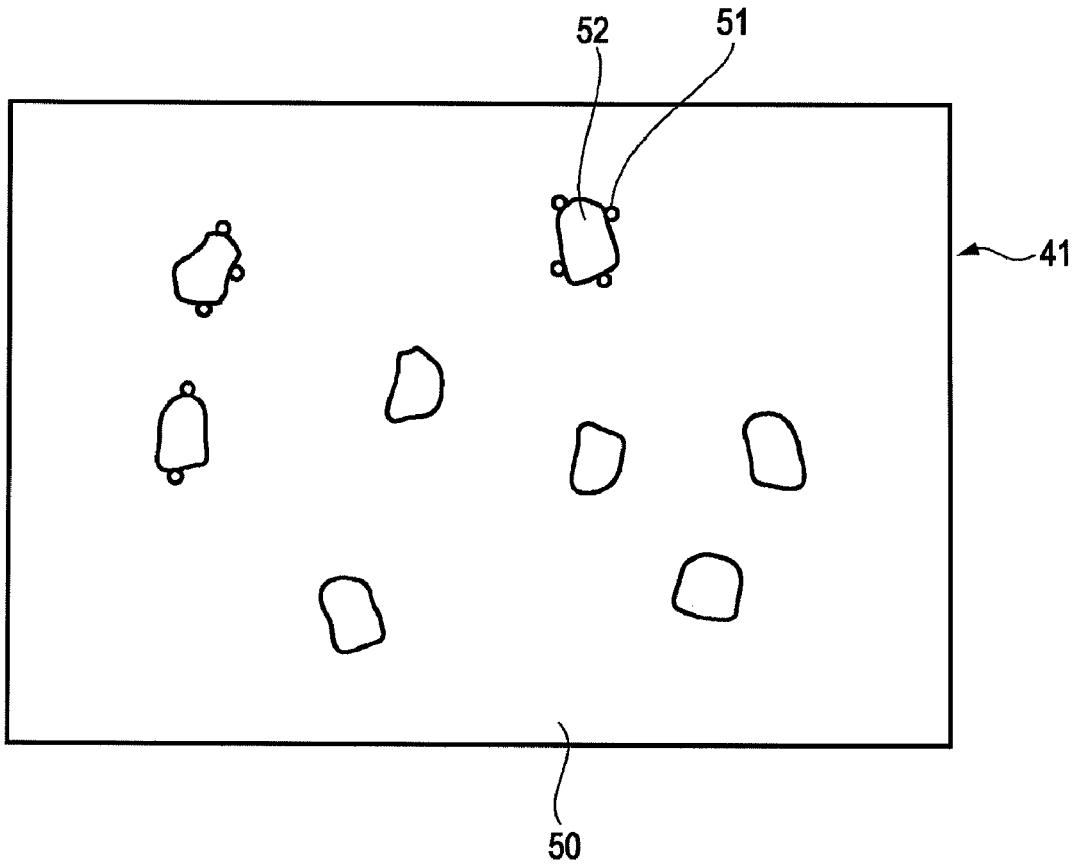

FIG. 5 is a schematic view showing the material state of an auxiliary elastic member according to an embodiment.

Figure 6:
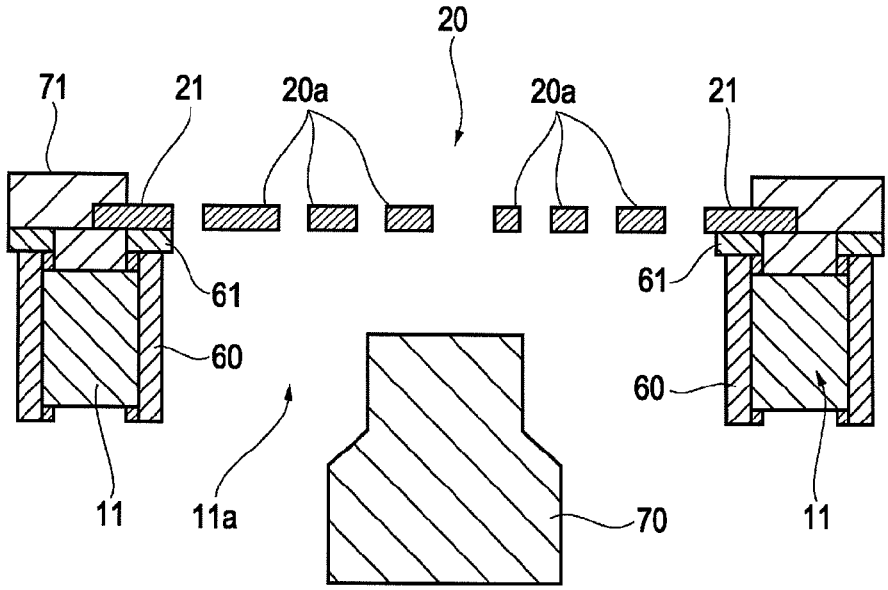

FIG. 6 is an illustration (a partial sectional view) showing a step of a method for manufacturing a spiral contact. In the step, the spiral contact is fixed on a base 11 and an elastically deforming portion of the spiral contact is three-dimensionally shaped so as to extend upward FIG. 7 is an illustration (a partial sectional view) showing a step subsequent to the step shown in FIG. 6.

Figure 7:
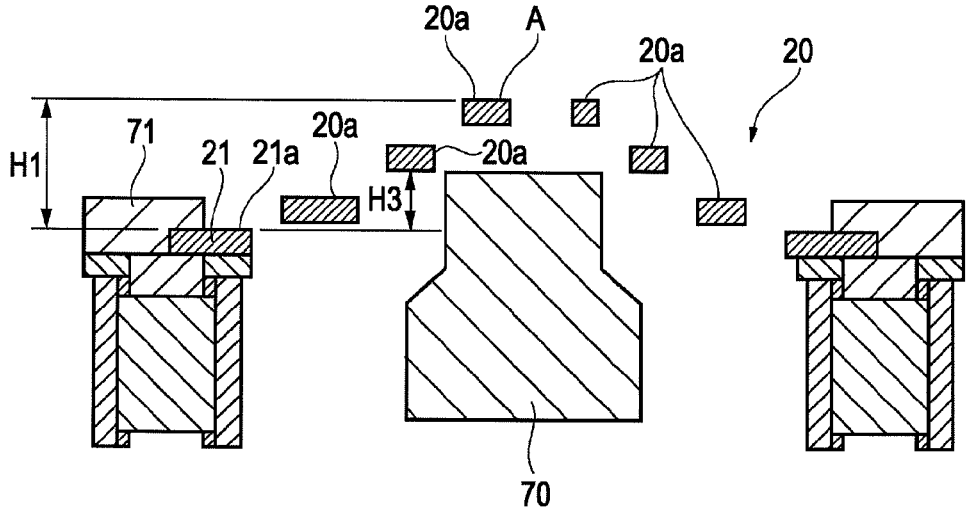
Figure 8:
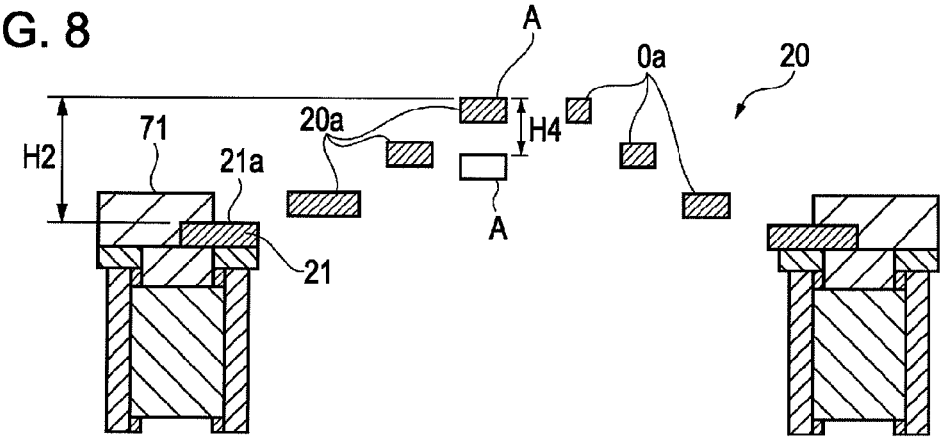

FIG. 8 is an illustration (a partial sectional view) showing a step subsequent to the step shown in FIG. 7.

Figure 9:
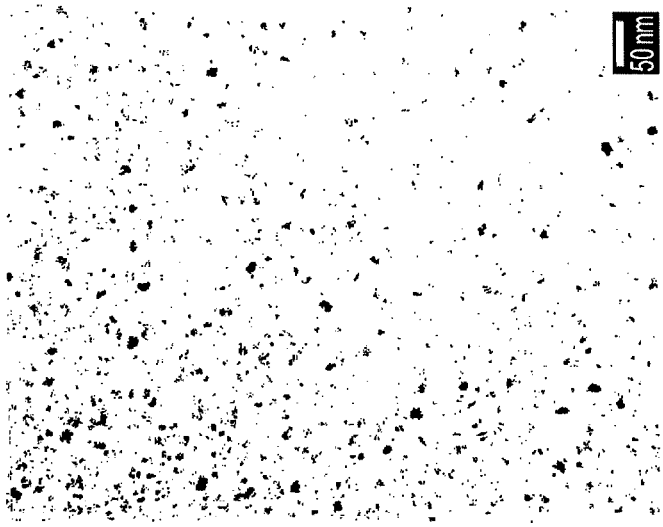

FIG. 9 is a TEM photograph of an unheated NiP alloy containing 12.5 atomic percent P.

Figure 10:
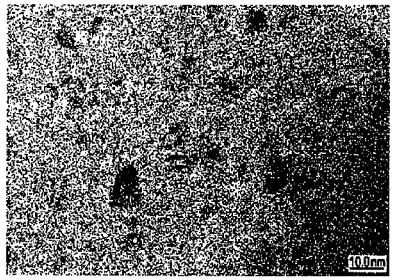

FIG. 10 is a TEM photograph of an NiP alloy, heated at 250° C. for one hour, containing 12.5 atomic percent P.

Figure 11:
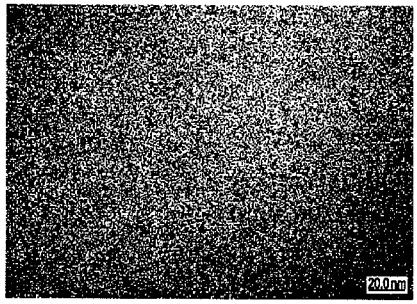
Figure 12:
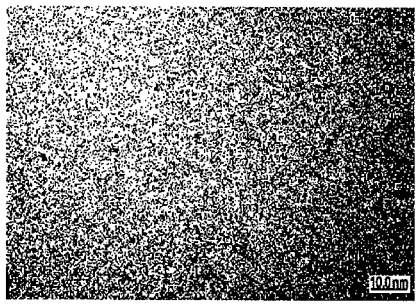

FIG. 11 is a TEM photograph of an unheated NiP alloy containing 19 atomic percent P FIG. 12 is a TEM photograph of an NiP alloy, heated at 250° C. for 36 minutes, containing 19 atomic percent P.

Figure 13:
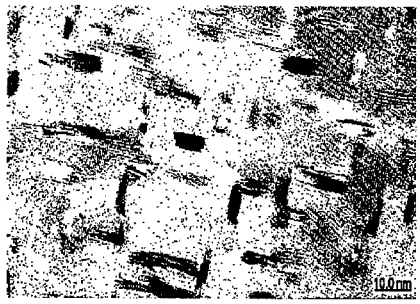

FIG. 13 is a TEM photograph of an NiP alloy, heated at 250° C. for one hour, containing 19 atomic percent P.

Figure 14:
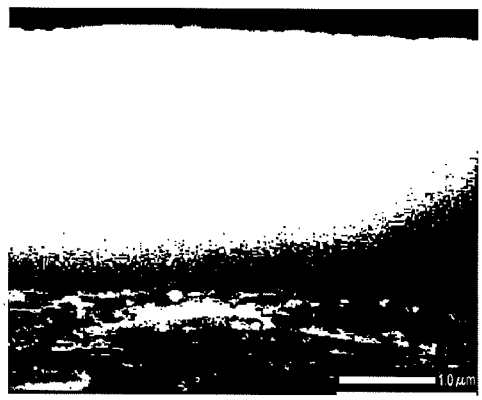

FIG. 14 is a TEM photograph of a composite member, heat-treated at 250° C. for one hour, including a copper substrate coated with an NiP alloy containing 15 atomic percent P by an electroless plating process.

Figure 15:
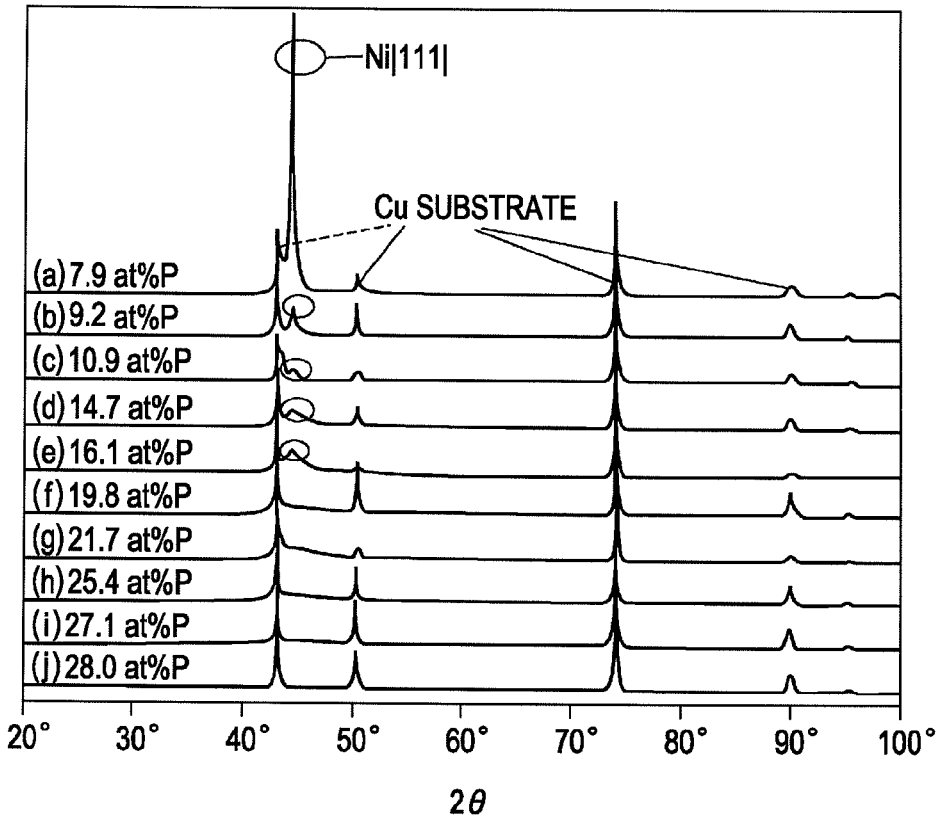

FIG. 15 includes X-ray diffraction patterns of a plurality of composite members (a) to (j), heated at 250° C. for one hour, including Cu substrates plated with NiP alloys having different P composition ratios.

Figure 16:
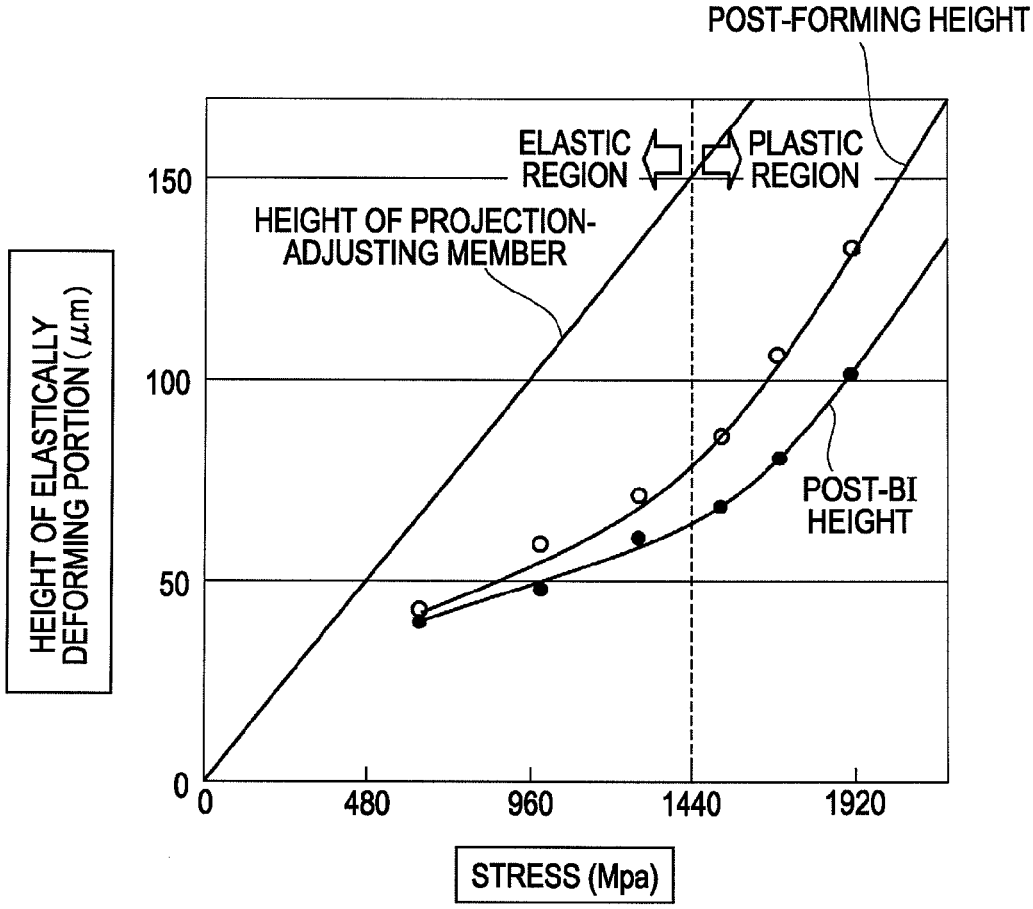

FIG. 16 is a graph showing the relationship between the stress applied to an elastically deforming portion of each spiral contact and the post-forming height and post-BI height of the elastically deforming portion, the elastically deforming portions being prepared in such a manner that copper foils with a spiral contact shape are coated with a NiP alloy (a P content of 19 atomic percent) by an electroless plating process, the elastically deforming portions being three-dimensionally shaped under predetermined conditions in such a manner that different stresses are applied to the elastically deforming portions, the elastically deforming portions being measured for height (post-forming height), the elastically deforming portions being heat-treated under predetermined conditions and then measured for height (post-BI height).

Figure 17:
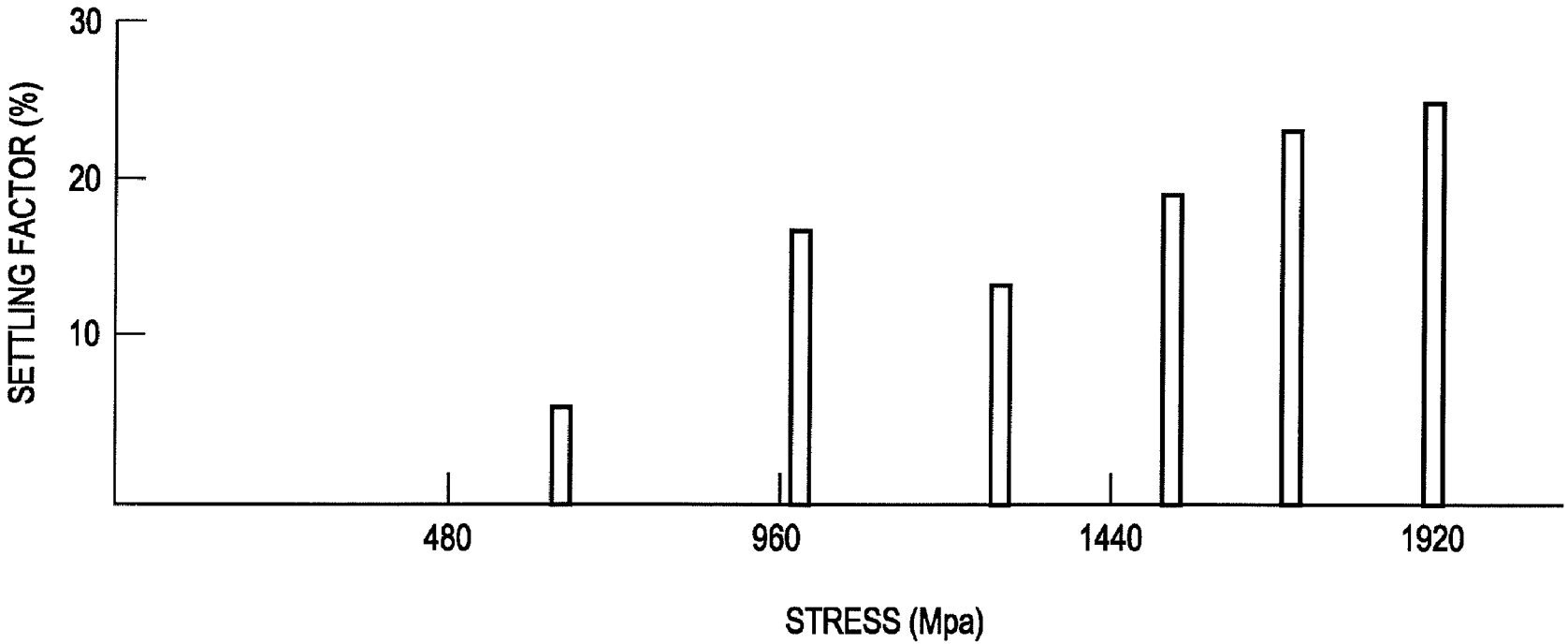

FIG. 17 is a graph showing the relationship between the stress applied to the elastically deforming portion of each spiral contact and the settling factor thereof, the settling factor being determined from the experiment results shown in FIG. 16.

Figure 18:
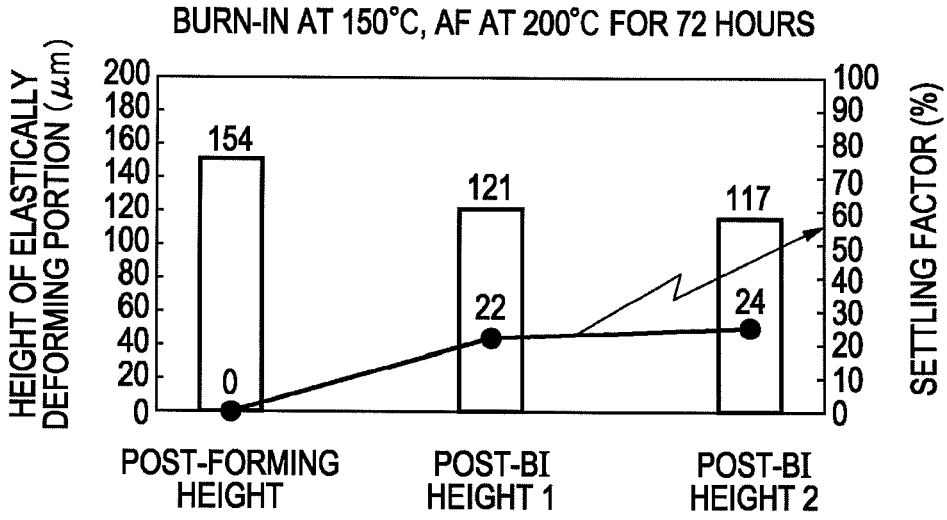

FIG. 18 is a graph showing the relationship between the settling factor of an elastically deforming portion of each spiral contact and the post-forming height, post-BI height 1, and post-BI height 2 of the elastically deforming portion, the spiral contact having the same configuration as that of those spiral contacts used in the experiment shown in FIG. 16, the elastically deforming portion being three-dimensionally shaped under predetermined conditions and then measured for height (post-forming height), the spiral contact being heated under predetermined conditions, the elastically deforming portion being measured for height (post-BI height 1), the spiral contact being heat-treated again under predetermined conditions, the elastically deforming portion being measured for height (post-BI height 2).

Figure 19:
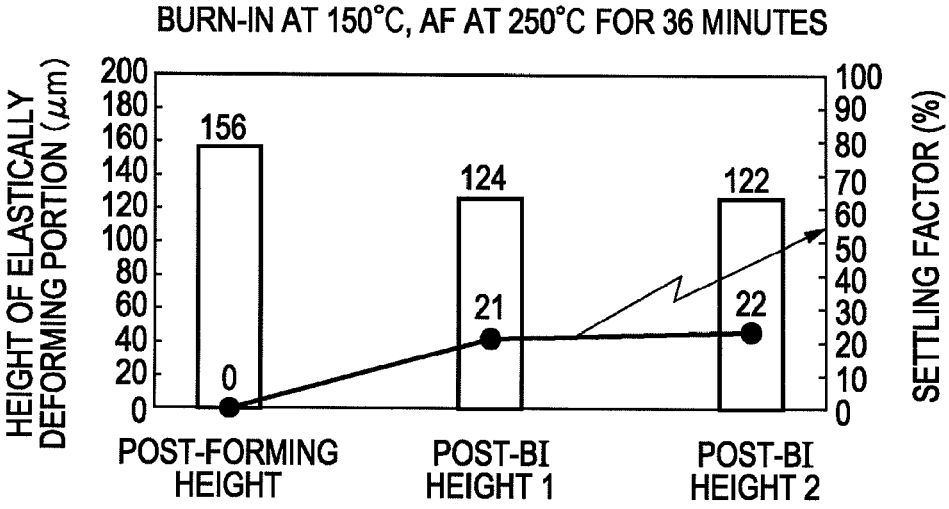

FIG. 19 is a graph showing the relationship between the settling factor of an elastically deforming portion of each spiral contact and the post-forming height, post-BI height 1, and post-BI height 2 of the elastically deforming portion, the spiral contact having the same configuration as that of those spiral contacts used in the experiment shown in FIG. 16, the elastically deforming portion being three-dimensionally shaped under predetermined conditions and then measured for height (post-forming height), the spiral contact being heated under predetermined conditions, the elastically deforming portion being measured for height (post-BI height 1), the spiral contact being heat-treated again under predetermined conditions, the elastically deforming portion being measured for height (post-BI height 2).

Figure 20:
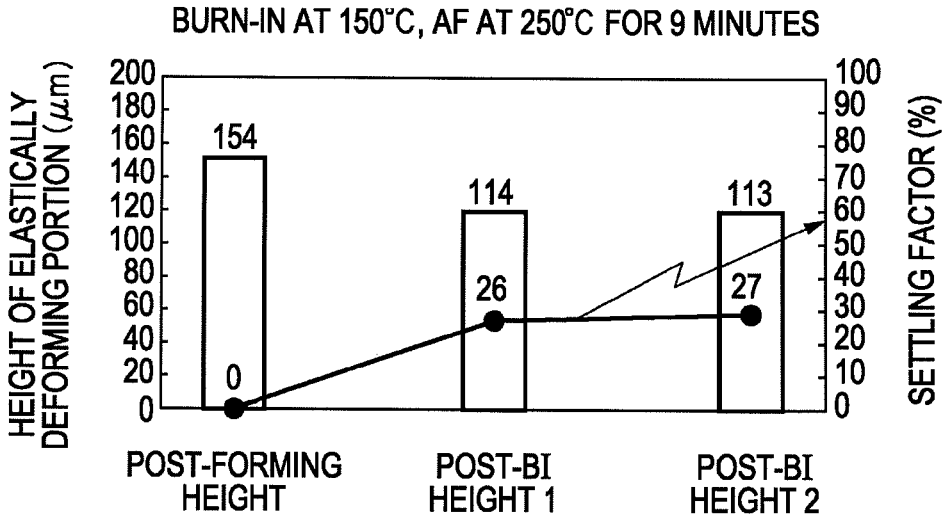

FIG. 20 is a graph showing the relationship between the settling factor of an elastically deforming portion of each spiral contact and the post-forming height, post-BI height 1, and post-BI height 2 of the elastically deforming portion, the spiral contact having the same configuration as that of those spiral contacts used in the experiment shown in FIG. 16, the elastically deforming portion being three-dimensionally shaped under predetermined conditions and then measured for height (post-forming height), the spiral contact being heated under predetermined conditions, the elastically deforming portion being measured for height (post-BI height 1), the spiral contact being heat-treated again under predetermined conditions, the elastically deforming portion being measured for height (post-BI height 2).

Figure 21:
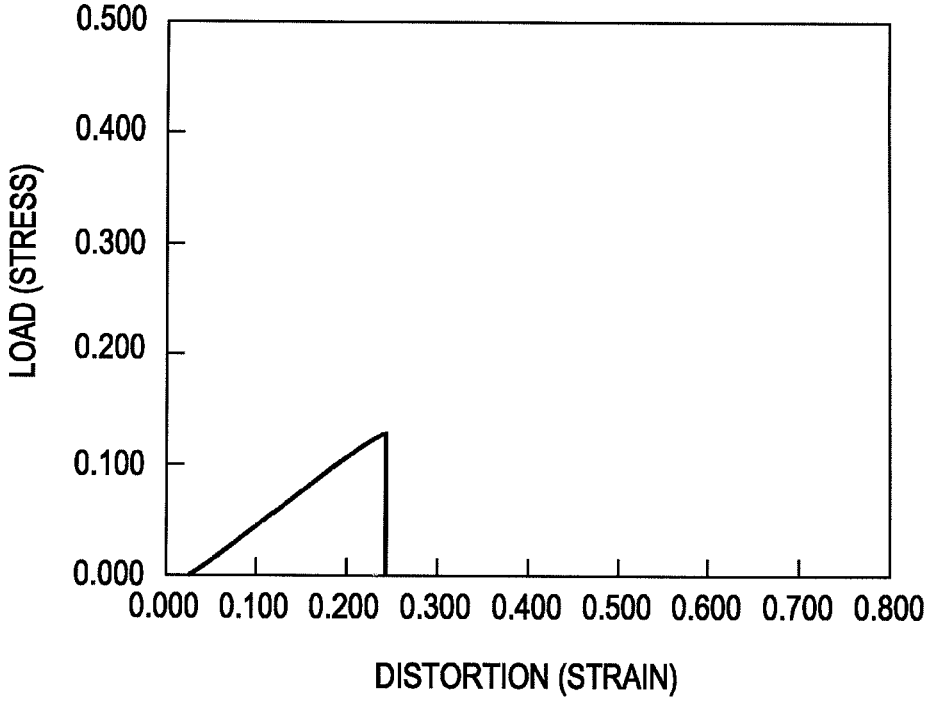

FIG. 21 is a graph showing the distortion of an elastically deforming portion of a spiral contact and the load applied to the elastically deforming portion, the spiral contact being prepared in such a manner that a copper foil is coated with an NiP alloy having a P composition ratio of 12.5 atomic percent by an electroless plating process, the elastically deforming portion being three-dimensionally shaped, a load being applied to the elastically deforming portion until the spiral contact is broken.

Figure 22:
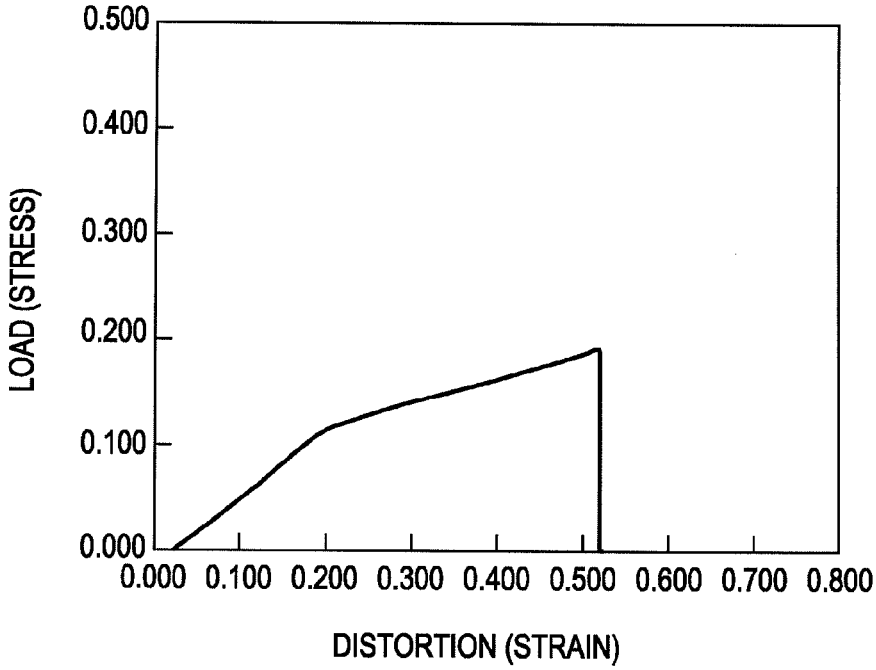

FIG. 22 is a graph showing the distortion of an elastically deforming portion of a spiral contact and the load applied to the elastically deforming portion, the spiral contact being prepared in such a manner that a copper foil is coated with an NiP alloy having a P composition ratio of 19 atomic percent by an electroless plating process, the elastically deforming portion being three-dimensionally shaped, a load being applied to the elastically deforming portion until the spiral contact is broken.

Figure 23:
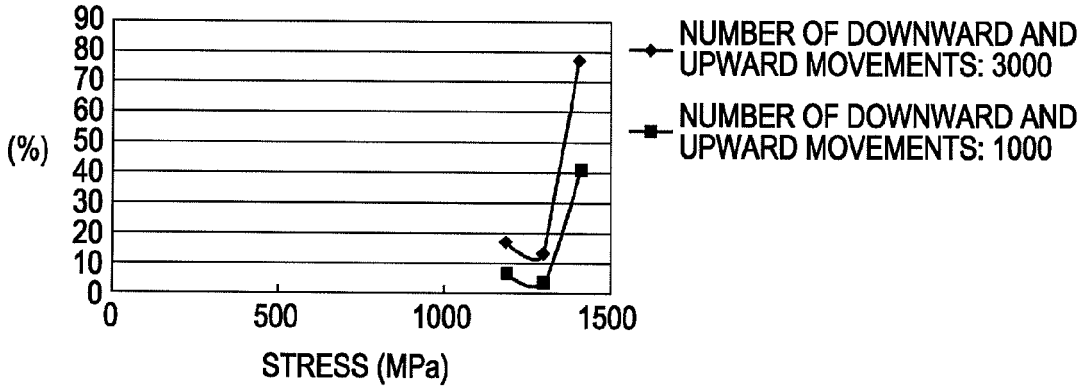

FIG. 23 is a graph showing the relationship between the percentage of broken elastically deforming portions of spiral contacts and the stress applied to each elastically deforming portion, the spiral contacts being prepared by coating copper foil with an NiP alloy having a P composition ratio of 12.5 atomic percent by an electroless plating process and then being three-dimensionally shaped, the elastically deforming portions being pressed with projecting members at a predetermined stress and then being separated from the projecting members, the projecting members being pressed against and then being separated from the elastically deforming portions 1000 or 3000 times.

Figure 24:
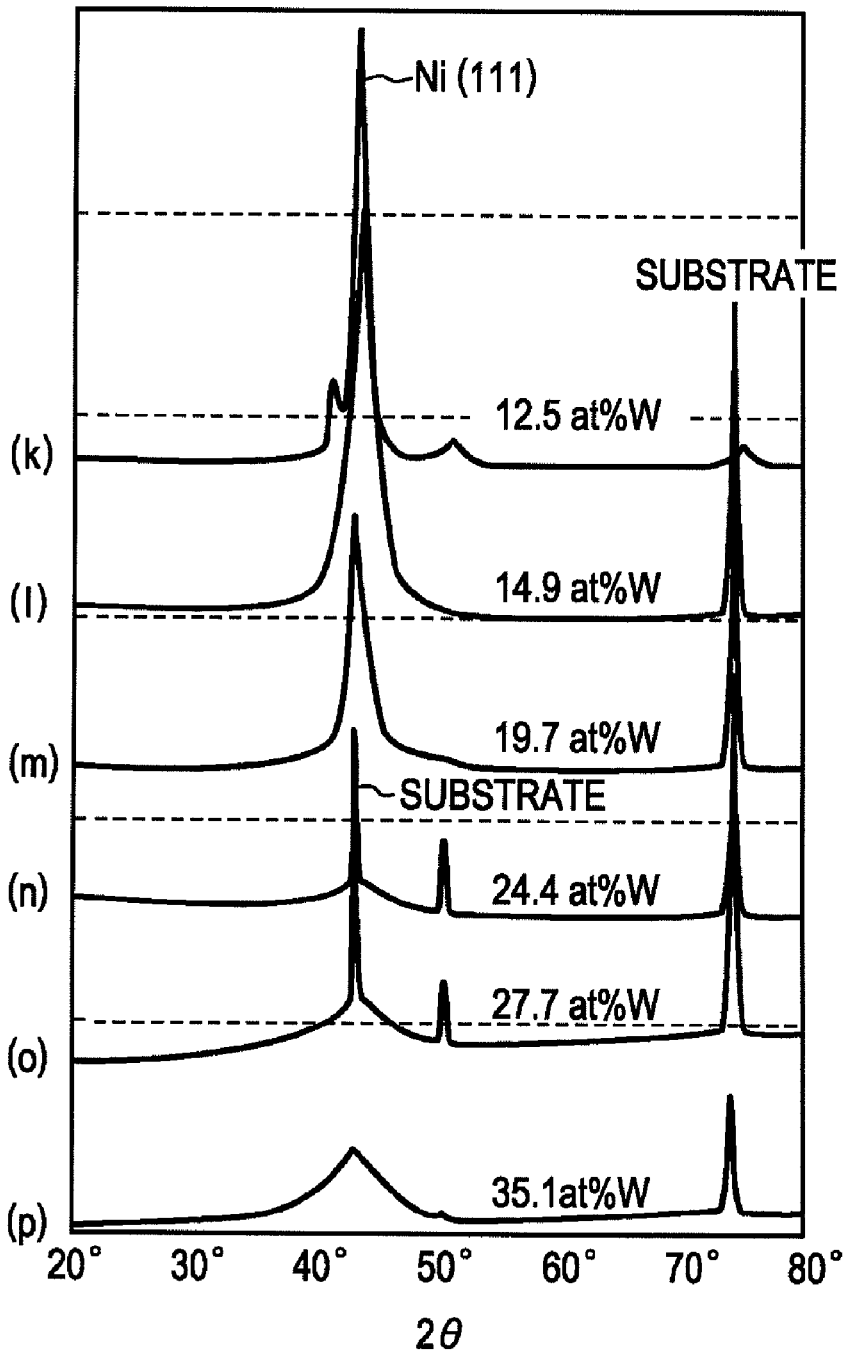

FIG. 24 includes X-ray diffraction patterns of composite members (k) to (p), heated at 250° C. for one hour, including Cu substrates plated with NiW alloys having different W composition ratios.

Figure 25:
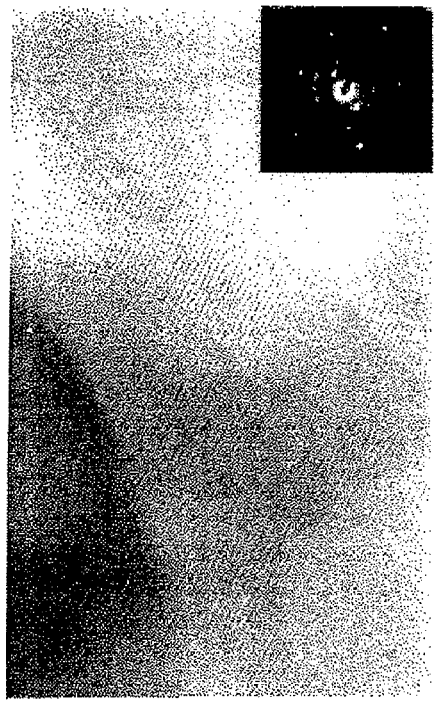

FIG. 25 includes a TEM photograph and transmission electron diffraction image of an NiW alloy, heated at 250° C. for one hour, containing 12.5 atomic percent W.

Figure 26:
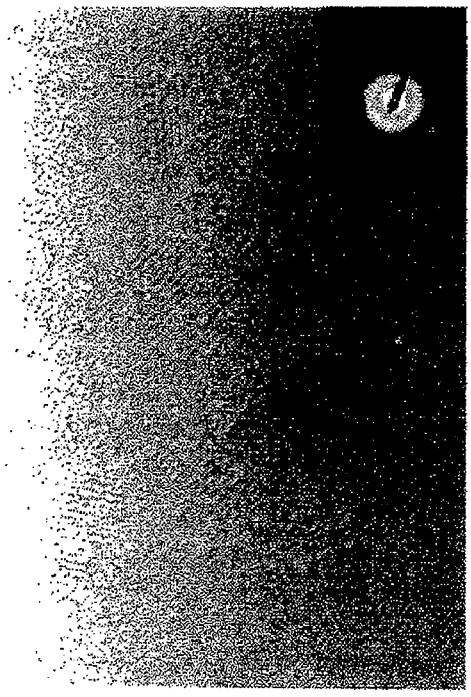

FIG. 26 includes a TEM photograph and transmission electron diffraction image of an NiW alloy, heated at 250° C. for one hour, containing 14.9 atomic percent W.

Figure 27:
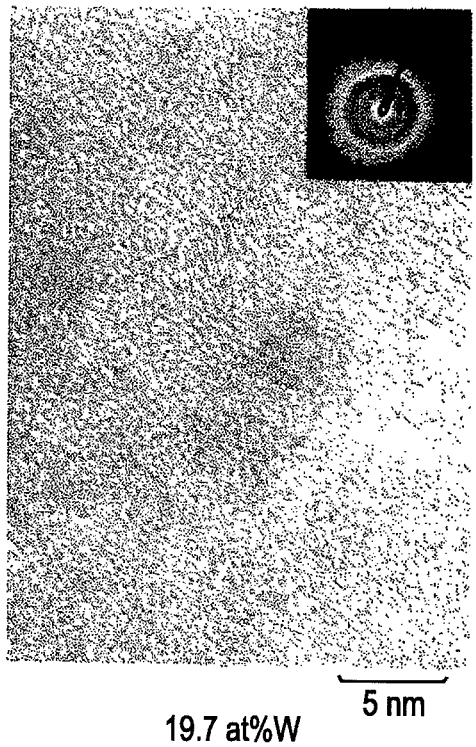

FIG. 27 includes a TEM photograph and transmission electron diffraction image of an NiW alloy, heated at 250° C. for one hour, containing 19.7 atomic percent W.

Figure 28:
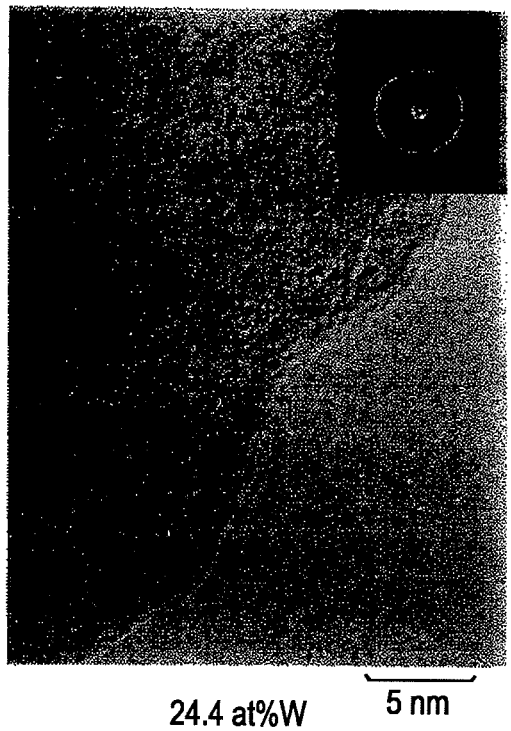

FIG. 28 includes a TEM photograph and transmission electron diffraction image of an NiW alloy, heated at 250° C. for one hour, containing 24.4 atomic percent W.

Figure 29:
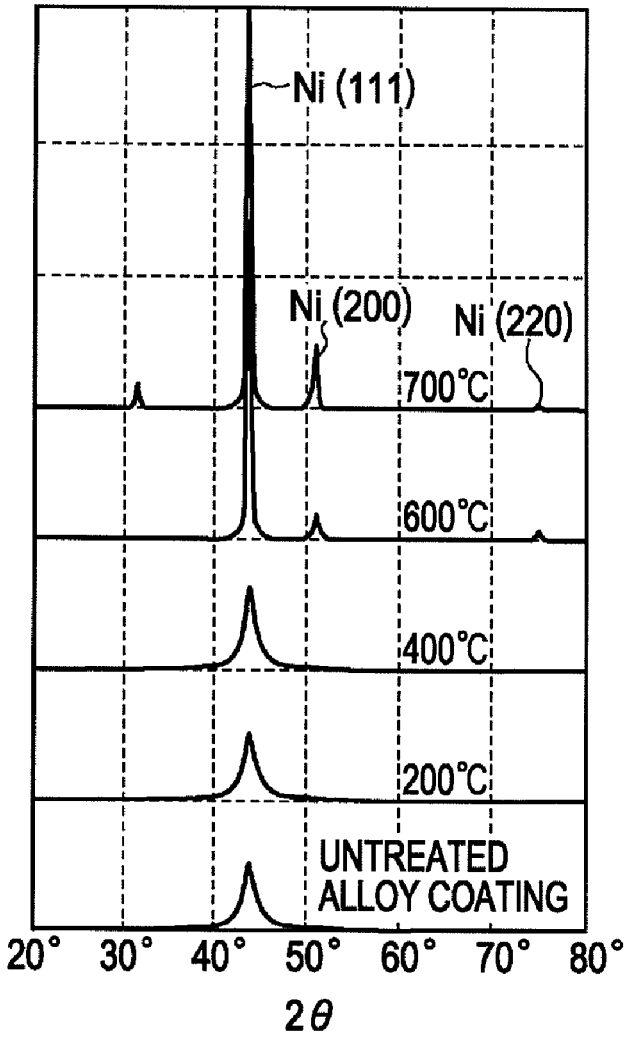

FIG. 29 includes X-ray diffraction patterns of composite members, heated at different temperatures, including Cu substrates plated with NiP containing 19.7 atomic percent W.

Figure 30:
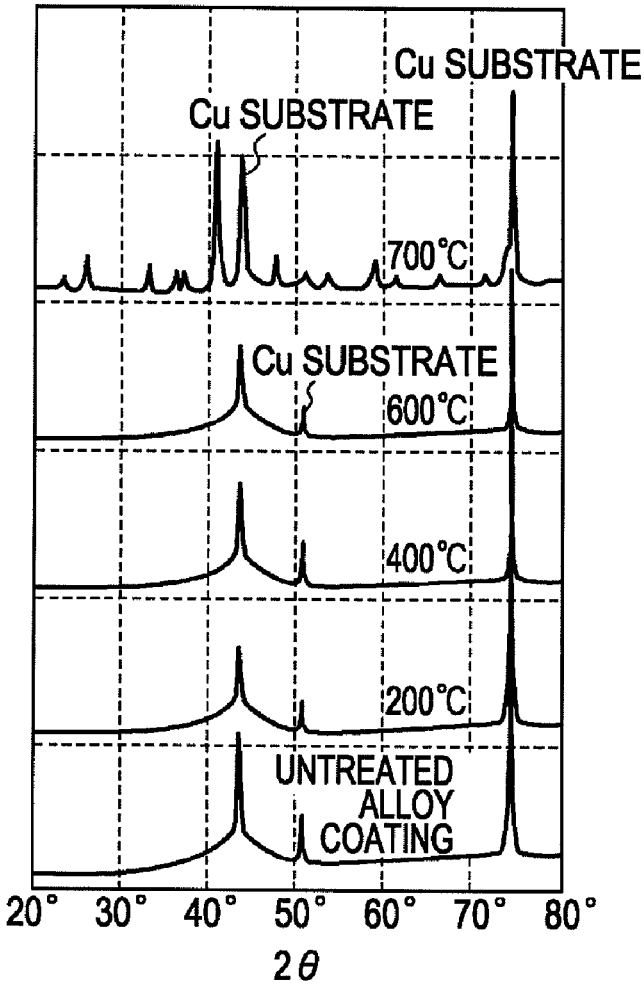

FIG. 30 includes X-ray diffraction patterns of composite members, heated at different temperatures, including Cu substrates plated with NiP containing 27.7 atomic percent W.

REFERENCE NUMERALS

1 electronic component
1*a* spherical contacts (connection terminals)
10 connection device
11 base
20 spiral contacts
20*a* elastically deforming portions
21 base portions
40 conductive members
41 auxiliary elastic members
42 coating members
50 amorphous phase
51 ultra-fine precipitates (embryos)
52 intermetallic compound crystals
70 projection-adjusting members

The invention claimed is:

1. A contact comprising an elastically deforming portion, wherein the elastically deforming portion comprises Ni—X (where X is at least one selected from the group consisting of P, W, and B) in an amorphous state including an amorphous phase and crystals scattered in the amorphous phase, wherein the amorphous phase occupies 60 volume percent or more in the Ni—X and the crystals have a diameter in a range from 3 nm to 15 nm.

2. The contact according to claim 1, wherein the crystals are intermetallic compound crystals formed of Ni—X.

3. The contact according to claim 1, wherein the elastically deforming portion is formed of only Ni—X.

4. The contact according to claim 1, wherein the elastically deforming portion is provided with an elastic region made of the Ni—X in a part of a cross section cut in a thickness direction.

5. The contact according to claim 1, wherein the elastically deforming portion includes a conductive member and an auxiliary elastic member, the conductive member has a resistivity less than that of the auxiliary elastic member, and the auxiliary elastic member has a yield point and elastic modulus greater than those of the conductive member and is formed of the Ni—X.

6. The contact according to claim 1, wherein the elastically deforming portion is entirely formed in the amorphous state.

7. The contact according to claim 1, wherein the element X is P.

8. The contact according to claim 7, wherein a composition ratio of P is 15 to 30 atomic percent.

9. The contact according to claim 1, wherein the element X is W.

10. The contact according to claim 9, wherein a composition ratio of W is 14.5 to 36 atomic percent.

11. The contact according to claim 10, wherein a composition ratio of W is 20 atomic percent or more.

12. The contact according to claim 1, wherein the Ni—X is formed by plating.

13. The contact according to claim 1, further comprising ultra-fine precipitates, having a size of 1 mn or less, in addition to the amorphous phase and the crystals.

14. The contact according to claim 1, wherein the elastically deforming portion has such a yield point that the load applied thereto is 19.6 mN or more and the distortion thereof is 0.1 mm or more.

15. The contact according to claim 1, wherein the elastically deforming portion is formed in a spiral shape.

16. The contact according to claim 1, wherein the elastically deforming portion is subjected to heating in a three-dimensionally-shaped state.

* * * * *